US008515333B2

(12) United States Patent
Motoyoshi

(10) Patent No.: US 8,515,333 B2
(45) Date of Patent: Aug. 20, 2013

(54) NOTCH FORMING DEVICE, BOOKBINDING APPARATUS AND BOOKBINDING SYSTEM

(75) Inventor: Tomoya Motoyoshi, Sagamihara (JP)

(73) Assignee: Konica Minolta Business Business Technologies, Inc., Tokyo (JP)

( * ) Notice: Subject to any disclaimer, the term of this patent is extended or adjusted under 35 U.S.C. 154(b) by 536 days.

(21) Appl. No.: 12/486,984

(22) Filed: Jun. 18, 2009

(65) Prior Publication Data

US 2010/0003108 A1 Jan. 7, 2010

(30) Foreign Application Priority Data

Jul. 1, 2008 (JP) ..... 2008-172210

(51) Int. Cl.
*G03G 15/00* (2006.01)
*B42C 5/04* (2006.01)

(52) U.S. Cl.
CPC ..... *B42C 5/04* (2013.01)
USPC ..... 399/407; 399/408; 412/33

(58) Field of Classification Search
CPC ..... B26F 1/12; B42C 5/04; B65H 35/00
USPC ..... 399/408; 412/37, 1, 6, 8, 9, 13, 412/33, 38, 901; 270/58.07
IPC ..... B42C 5/04
See application file for complete search history.

(56) References Cited

U.S. PATENT DOCUMENTS

| | | | | |
|---|---|---|---|---|
| 6,907,806 | B1 * | 6/2005 | Okamoto et al. | 83/76.8 |
| 2006/0022395 | A1 * | 2/2006 | Tanigami et al. | 270/58.08 |
| 2006/0115290 | A1 * | 6/2006 | Nakamura et al. | 399/82 |
| 2007/0045928 | A1 | 3/2007 | Yoshie et al. | |
| 2008/0219802 | A1 * | 9/2008 | Hata | 412/12 |
| 2009/0290959 | A1 * | 11/2009 | Hata | 412/33 |

FOREIGN PATENT DOCUMENTS

| | | | |
|---|---|---|---|
| JP | 2001-261221 | A | 9/2001 |
| JP | 2007-62145 | A | 3/2007 |

OTHER PUBLICATIONS

Japanese Office Action dated Jun. 22, 2010 and English translation thereof, issued in counterpart Japanese Application No. 2008-172210.

* cited by examiner

*Primary Examiner* — Daniel J Colilla
*Assistant Examiner* — Ruben Parco, Jr.
(74) *Attorney, Agent, or Firm* — Holtz, Holtz, Goodman & Chick, P.C.

(57) ABSTRACT

A notch forming device, comprises a notch forming section to form a notch on an edge of a sheet constituting a sheet bundle to be outputted in accordance with an execution of a job; a shifting section to shift a position of a notch to be formed on a sheet by the notch forming section; and a control section to control the shifting section. When plural sheet bundles are outputted in accordance with the execution of the job, the control section controls the shifting section to make a position of a notch on a leading sheet of each sheet bundle at the same position.

7 Claims, 20 Drawing Sheets

PRIOR ART

PRIOR ART

NOTCH FORMING DEVICE, BOOKBINDING APPARATUS AND BOOKBINDING SYSTEM

This application is based on Japanese Patent Application No. 2008-172210 filed on Jul. 1, 2008 in Japanese Patent Office, the entire content of which is hereby incorporated by reference.

BACKGROUND OF THE INVENTION

The present invention relates to a notch forming device for forming a notch on the edge of a sheet having been conveyed, and a bookbinding apparatus and bookbinding system for stacking plural sheets with notches formed thereon into a sheet bundle and for producing a booklet by gluing the sheet bundle with adhesive.

Various kinds of techniques have been proposed to stack plural sheets with images formed thereon into a sheet bundle and produce a booklet by gluing the sheet bundle and a cover sheet with an adhesive. For example, in a bookbinding system including an image forming apparatus such as a copying machine and a printer, plural sheets on which images are formed by the image forming apparatus are stacked automatically into a sheet bundle, and a cover sheet is pasted onto the sheet bundle with an adhesive to produce a booklet.

Here, a general procedure to produce a booklet in this bookbinding system will be explained. First, a plurality of sheets on which images are formed are collected and aligned into a sheet bundle. Next, an adhesive is coated on a spine of the collected aligned sheet bundle. Then, a cover sheet is conveyed and stopped at a predetermined position, and the cover sheet is pasted onto the spine of the sheet bundle. In this procedure, a plurality of sheets and a cover sheet are made in one body, whereby a booklet is produced.

FIGS. 17*a* and 17*b* each shows an example of a booklet constituted by a sheet bundle and a cover sheet.

FIG. 17*a* shows a condition that a cover sheet K is not folded, and FIG. 17*b* shows a condition that the cover sheet K is folded. As shown in FIG. 17*a*, the pine Sb of a sheet bundle Sa is coated with an adhesive, and the sheet bundle Sa is shifted in the arrowed direction and is joined with the cover sheet K. Thereafter, the sheet bundle Sa is covered in the form of capital U by the cover sheet K. On the final condition of a booklet, as shown in FIG. 17*b*, the side edge Se of the sheet bundle Sa is aligned with the side edge Ke of the cover sheet K.

Here, in some cases, there is a problem that if the spine Sb of a sheet bundle Sa is coated with an adhesive without a special treatment and the sheet bundle Sa is joined with a cover sheet K to produce a booklet, a jointing force between the sheet bundle Sa and the cover sheet K is not secured sufficiently and a part of sheets falls out of the produced booklet.

In order to solve the above problem, as shown in FIG. 18, notches V are formed on the edge of a sheet S. When a plurality of sheets with such notches formed on their edges are stacked into a sheet bundle Sa, notch grooves Va constituted by the notches V are formed on the spine Sb of the sheet bundle Sa as shown in FIG. 19*a*. For example, as shown in FIG. 19*b* which shows the condition of the spine Sb of the sheet bundle Sa viewed from the direction of X in FIG. 19*a*, a notch grooves Va are formed in a vertical straight form.

In this way, with the structure that notches V are formed on the edge of sheets S, a space to receive a sufficient amount of an adhesive is secured between the spine of a sheet bundle and a cover sheet, whereby a sufficient adhesive force can be secured between the spine of a sheet bundle and a cover sheet.

A technique to form notches V on the edge of sheets S is disclosed by Japanese Patent Unexamined Publication No. 2001-261221 and Japanese Patent Unexamined Publication No. 2007-62145. In these publications, a notch forming section is provided on a conveying path to convey a sheet with images formed thereon such that notches V as shown in FIG. 18 are formed automatically on the edge of sheets S.

The positions of notches V formed on sheets S can be set up variously, for example, it may be considered that the positions of notches V are shifted for each sheet in such a way that the notch grooves Va constituted by the notches V are shaped into a slant form as shown in FIG. 20*a*. With this structure that the positions of notches V are shifted for each sheet, an adhesive is introduced into the shifted regions between sheets indicated with oblique lines in FIG. 20*b*, whereby an adhesive strength between the sheets can be secured.

Here, a study is made on the case where plural booklets are produced continuously by the form of a sheet bundle in which notch grooves Va with a slant form are formed. For example, it is presupposed that plural sheet bundles Sa in which notch grooves Va are formed in a zigzag bent form as shown in FIGS. 21*a* through 21*c* is produced successively and plural booklets are produced continuously by pasting a cover sheet on each of the plural sheet bundles Sa. The sheet bundle Sa shown in FIG. 21*a* is a sheet bundle constituting the first booklet, the sheet bundle Sa shown in FIG. 21*b* is a sheet bundle constituting the second booklet, and the sheet bundle Sa shown in FIG. 21*c* is a sheet bundle constituting the third booklet. Here, in each sheet bundle, a sheet of the leading page is positioned at the lowermost position and a sheet of the last page is positioned at the uppermost position.

The positions of notches in the last page of a sheet bundle Sa shown in FIG. 21*a* are the same as the positions of notches in the leading page of a sheet bundle Sa shown in FIG. 21*b*. Further, the positions of notches in the last page of a sheet bundle Sa shown in FIG. 21*b* are the same as the positions of notches in the leading page of a sheet bundle Sa shown in FIG. 21*c*. Namely, in plural sheet bundles Sa produced successively, the positions of notches in the last page of the previous sheet bundle are the same as the positions of notches in the leading page of the next sheet bundle. Therefore, the positions of notches in the leading page of the sheet bundle Sa shown in FIG. 21*a* and FIG. 21*c* are different from the positions of notches in the leading page of the sheet bundle Sa shown in FIG. 21*b*.

As shown in FIGS. 21*a* through 21*c*, if the positions of notches in the leading page of each sheet bundle Sa are not the same positions, since a notch grooves Va in a zigzag bent form stats from the positions of notches in the leading page, the form of the notch grooves Va in the sheet bundle Sa in FIG. 21*a* and FIG. 21*c* are different from that of the notch grooves Va in the sheet bundle Sa in FIG. 21*b*.

In the case that a booklet is produces in such a way a cover sheet is pasted onto a sheet bundle Sa, since the notch grooves Va are covered with a cover sheet, the condition of the sheet bundle cannot be observed directly. However, for example, if a booklet is produced with a thin cover sheet, the form of notch grooves Va on the pine of a booklet can be observed through the thin cover sheet. Therefore, if the form of notch grooves Va are different among plural booklets produced successively as shown in FIGS. 21*a* through 21*c*, they look horrible. Further, if a booklet is produced in such a way that a sheet bundle Sa is merely coated with an adhesive without being covered with a cover sheet thereon, notch grooves Va are observed directly on the condition of the booklet, especially such a bad appearance is conspicuous.

Further, if the form of notch grooves Va are different among plural booklets, the positions on which a large amount of adhesive is adhered become different. Therefore, in the case that a cover sheet is pasted on a sheet bundle, an adhesive force between the cover sheet and the sheet bundle may become different among the plural booklets.

SUMMARY OF THE INVENTION

One aspect of the present invention is as follows.

A notch forming device comprises:

a notch forming section to form a notch on an edge of a sheet constituting a sheet bundle to be outputted in accordance with an execution of a job;

a shifting section to shift a position of a notch on a sheet on which a notch is formed by the notch forming section; and a control section to control the shifting section;

wherein in the case of outputting plural sheet bundles in accordance with an execution of a job, the control section the shifting section to make a position of a notch on a leading sheet of each sheet bundle at the same position.

Further, a bookbinding apparatus according to one aspect of the present invention comprises:

the above-mentioned notch forming device; and a bookbinding section to collect sheets on which notch are formed by the notch forming section, to form a sheet bundle, to coat an adhesive onto a side of the sheet bundle on which notches are formed, and to bind the sheet bundle so as to produce a booklet.

Further, a bookbinding system according to one aspect of the present invention comprises:

an image forming apparatus to form images on sheets; and the above-mentioned bookbinding apparatus to produce a booklet by the use of the sheets on which images are formed by the image forming apparatus.

DETAILED DESCRIPTION OF THE PREFERRED EMBODIMENTS

Hereafter, an embodiment of the present invention will be described with reference to drawings. However, the present invention is not limited to the embodiment.

[Outline of a Bookbinding System]

Figure 1:
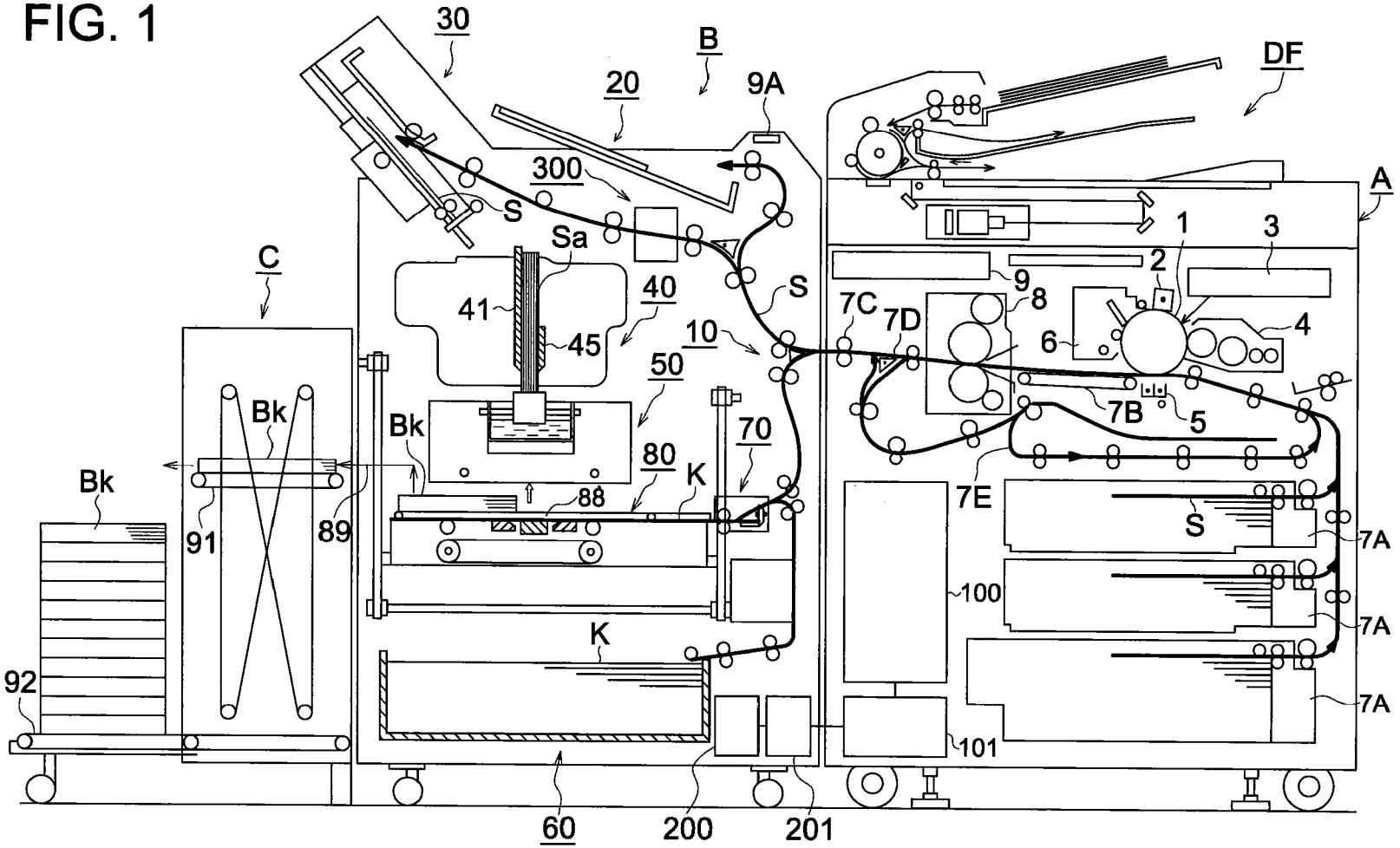
FIG. 1 is an overall schematic view representing a bookbinding system provided with an image forming apparatus, bookbinding apparatus, booklet storage apparatus, and automatic document feeder.

FIG. 1 is an overall schematic view representing a bookbinding system provided with an image forming apparatus A, a bookbinding apparatus B, a booklet storage apparatus C, and an automatic document feeder DF.

The image forming apparatus A includes an image forming section which is provided with a rotating image carrying member 1 and a charging section 2, an image exposing section 3, a developing section 4, a transfer discharging section 5, and a cleaning section 6 arranged around the rotating image carrying member 1. After the surface of the image carrying member 1 has been charged by the charging section 2, the image forming section performs exposure and scanning operations by a laser beam of the image exposing section 3 based on the image data captured from the document, whereby a latent image is formed. This latent image is developed by the developing section 4, and a toner image is formed on the surface of the image carrying member 1.

A sheet S fed from a sheet storing section 7A is conveyed to the transfer position of the image carrying member 1. At the transfer position, the toner image is transferred onto a sheet S by the transfer discharger 5. After that, the electric charge on the surface of the sheet S is erased. The sheet S is separated from the image carrying member 1 and is conveyed by the conveying section 7B. After that, the toner image on the sheet S is heated and fixed onto the sheet S by the fixing section 8. The sheet S is delivered from the image forming apparatus A by the sheet delivering roller 7C.

When images are to be formed on both sides of the sheet S, a sheet S having been heated to fix an image thereon by the fixing section 8 is branched off from a delivering path by a conveying path switching section 7D, and is switched back by the inversely conveying section 7E so that the sheet S is reversed. The sheet S is again conveyed to the image forming section, whereby an image is formed on the rear of the sheet S. The sheet S delivered from the sheet delivering roller 7C is fed into the bookbinding apparatus B.

The operating section 9 is mounted on the upper portion of the image forming apparatus A. Here, a user can input the contents of a job to be executed by the bookbinding system through the operating section 9.

As shown in FIG. 1, the bookbinding apparatus B is a wrapping-type bookbinding apparatus including a conveying path 10, a sheet delivering section 20, an inversing section 30, a sheet bundle accommodating section 40, coating section 50, cover sheet supply section 60, cutting section 70, and booklet forming section 80. The present invention is also applicable to the glued bookbinding apparatus wherein sheet bundles are simply glued by adhesive, in addition to the wrapping-type bookbinding apparatus.

[Block Diagram of the Bookbinding System]

Figure 2:
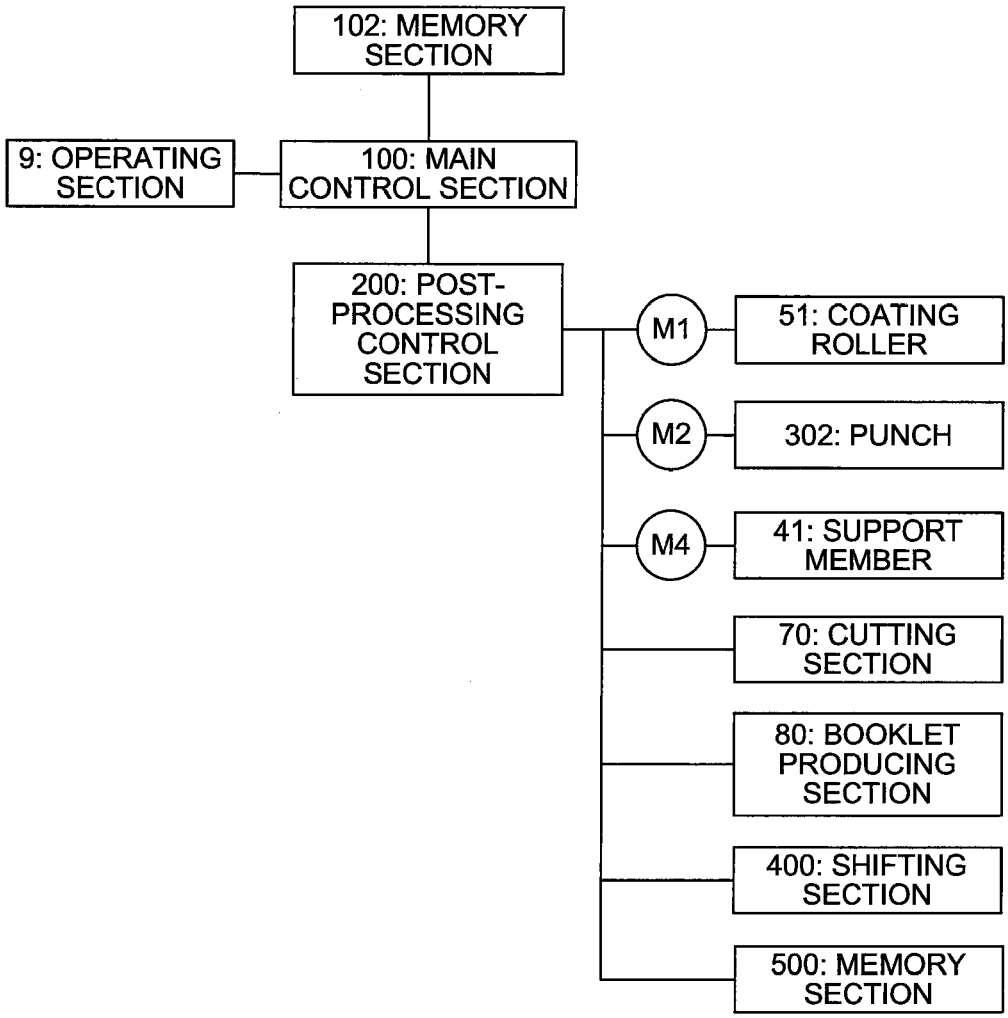
FIG. 2 is a block diagram representing a control system of the bookbinding system.

FIG. 2 is a block diagram representing a control system of the bookbinding system. The following describes only the representative components. The main control section 100 of the image forming apparatus A and the post-processing control section 200 of the bookbinding apparatus B are connected with each other by serial communication sections 101 and 201 (FIG. 1). In response to the command from the main control section 100, the post-processing control section 200 controls various components of the bookbinding apparatus B. In the present embodiment, the post-processing control section 200 serves as a control section.

To bind a booklet, the post-processing control section 200 controls the drive of various sections described later. To be more specific, the post-processing control section 200 controls the operations of a motor M1 for driving a coating roller 51, a motor M2 for driving the punch 302 of a notch forming unit 300, a motor M4 for driving a supporting member to support a sheet bundle, a shifting section 400 for driving a notch forming unit 300, a booklet forming section 80, and a cutting section 70.

[Outline of a Bookbinding Apparatus]

Figure 3:
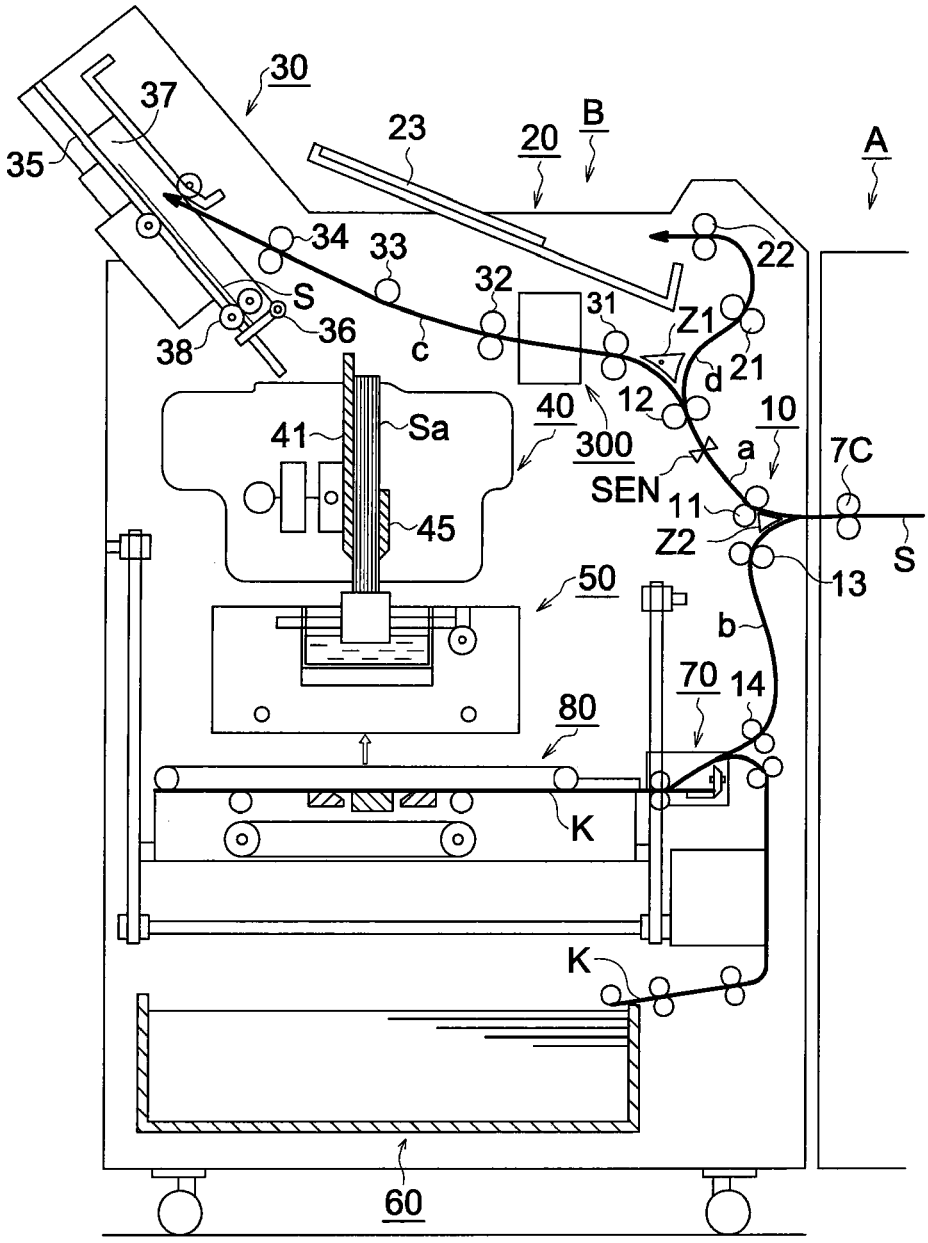
FIG. 3 is a cross sectional view showing the central portion of the bookbinding apparatus.

FIG. 3 is a cross sectional view showing the central portion of the bookbinding apparatus B. The conveying path switching section Z2 arranged on the upstream side in the sheet feeding direction of the conveyance roller 11 ensures that the sheet S delivered from the image forming apparatus A is branched off to either the conveying path "a" or conveying path "b". The sheet S conveyed to the conveying path "a" is sandwiched and conveyed by the conveyance rollers 11 and 12, and is branched off to either the sheet delivering section 20 or inversing section 30 by the conveying path switching section Z1. The sheet S having been conveyed to the conveying path "b" is sandwiched by the conveyance roller 14, and is fed into the booklet forming section 80 that serves as a bookbinding section. A sheet detecting sensor SEN is mounted on the conveying path "a". This sheet detecting sensor SEN detects the sheet S conveyed along the conveying path "a".

When the sheet S is to be delivered to the sheet delivering section 20, the conveying path switching section Z1 blocks the conveying path "c" leading to the sheet bundle accommodating section 40, and opens the conveying path "d" leading to the sheet delivering section 20. The sheet S passing through the conveying path "d" leading to the sheet delivering section 20 is sandwiched by the conveyance roller 21 and is conveyed upward. This sheet S is then delivered into the fixed ejection tray 23 on the upper portion of the apparatus by the sheet delivering roller 22.

The sheet S branched off to the conveying path "c" by the conveying path switching section Z1 is sandwiched by the conveyance rollers 31, 32, 33 and 34, and is accommodated in a predetermined position of the inversing section 30. The inversing section 30 includes a sheet placement table 35 arranged at an inclined position, a positioning member 36 for determining the position of the trailing edge of the sheet, an aligning member 37 for aligning the sheet S across the width, and a conveying roller 38.

Figure 4:
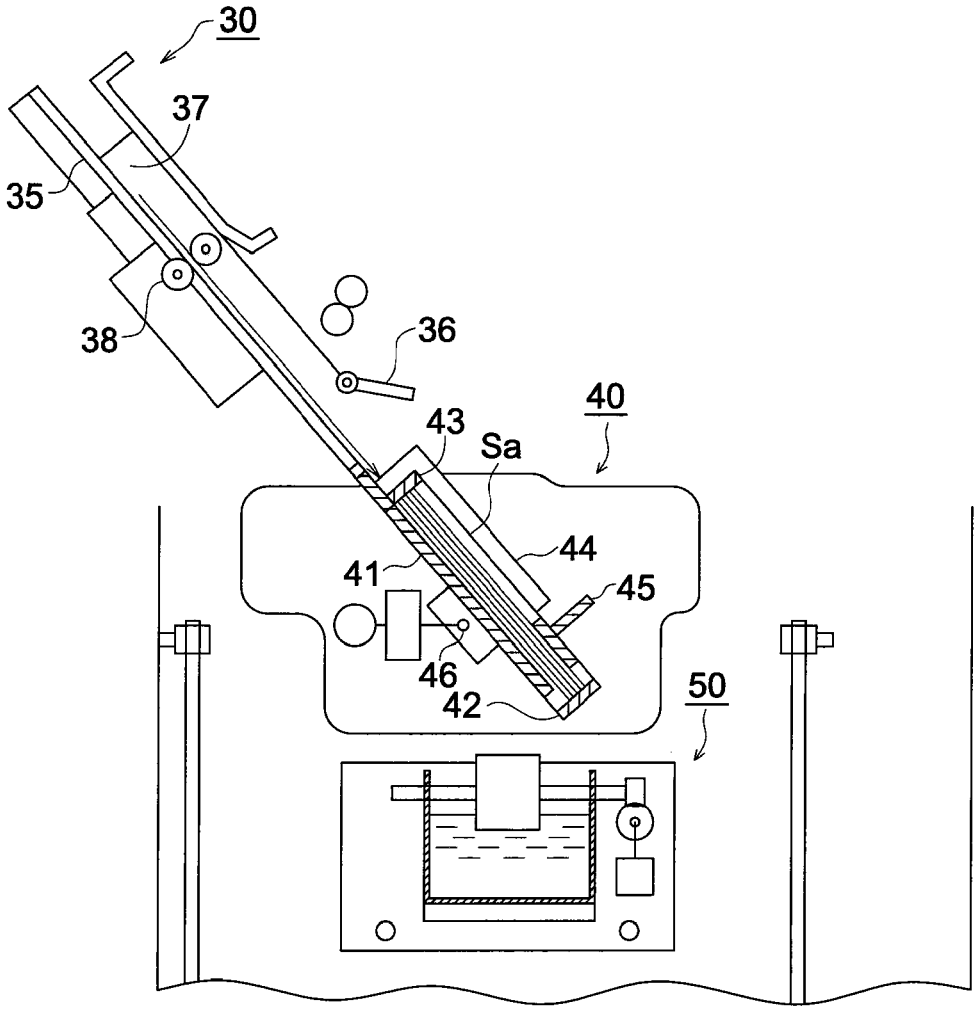
FIG. 4 is a cross sectional view showing that the sheet stacking section of the sheet bundle accommodating section is inclined.

FIG. 4 is a cross sectional view showing that the sheet stacking section of the sheet bundle accommodating section 40 is inclined. The sheet bundle accommodating section 40 includes a supporting member 41, holding plate 42, lateral aligning member 44, and pressing member 45.

The sheet S placed on the sheet placement table 35 of a inversing section 30 is sandwiched by the conveying roller 38, and is delivered from the opening formed by the rocking motion of a positioning member 36. The sheet S is then conveyed in a downward slanting direction. The sheet S is sequentially stacked in the sheet bundle accommodating section 40.

The sheet bundle accommodating section 40 includes a supporting member 41 having an inclined stacking surface and a holding plate 42 that can be rocked. The sheet S coming downward from the inversing section 30 slides down onto the stacking surface of the inclined supporting member 41, and is stopped when the leading edge of the sheet S has come in contact with the holding plate 42, whereby the sheets S are supported in the inclined state. The longitudinally aligning member 43 presses the trailing edge of the sheets S in conformance to the size of the sheets S placed on the stacking surface of the supporting member 41, so that the leading edges of the sheets S are brought in contact with the holding plate 42. This procedure ensures that the leading edges of the sheets S are aligned. The sheet S sequentially delivered from the image forming apparatus A is switched backed by the inversing section 30, and is stacked on the sheet bundle accommodating section 40, whereby a sheet bundle Sa made up of a plurality of sheets S is formed.

The size of the sheets S and the number of sheets of the sheet bundle Sa as the setting conditions of the booklet to be bound by the bookbinding apparatus B are set on the operating section 9 of the image forming apparatus A, or on an external device such as a personal computer linked to the image forming apparatus A.

The lateral aligning member 44 presses the side edge of the sheets S conveyed from the inversing section 30 and accommodated in the sheet bundle accommodating section 40 to achieve lateral alignment of the sheets across the width.

The sheet bundle Sa stacked on the sheet bundle accommodating section 40 is pressed by the pressing member 45 along the thickness, whereby the sheet bundle Sa is sandwiched. When a preset number of sheets S have been stored in the sheet bundle accommodating section 40, the pressing member 45 is driven by a motor (not illustrated), and the sheet bundle Sa is sandwiched by the supporting member 41 and pressing member 45.

Figure 5:
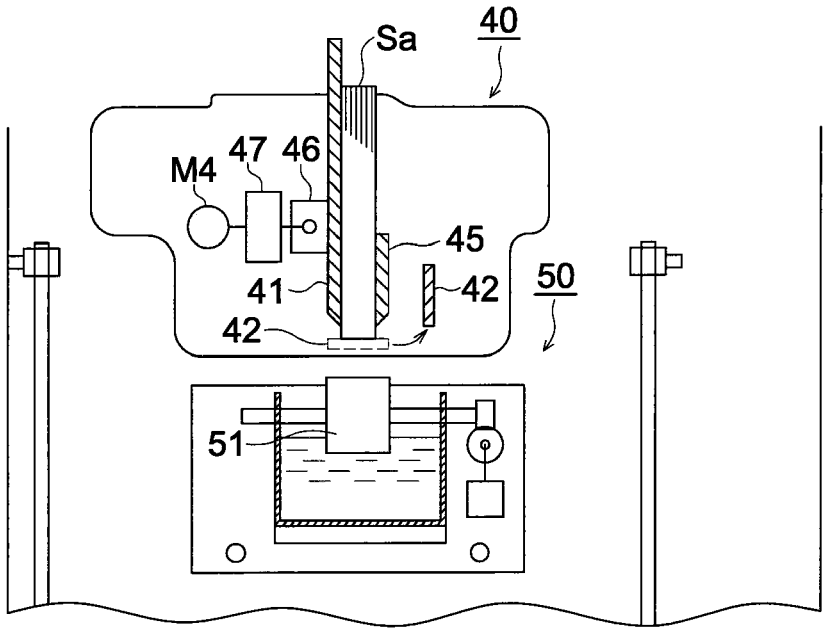
FIG. 5 is a cross sectional view showing that the sheet stacking section of the sheet bundle accommodating section is in the upright position.

FIG. 5 is a cross sectional view showing that the sheet stacking section of the sheet bundle accommodating section 40 is in the upright position.

The supporting member 41 and pressing member 45 sandwiching the sheet bundle Sa are rotated around the axis 46 of the sheet bundle accommodating section 40 by the motor M4 and driving section 47 until the sheet bundle Sa in the inclined position is raised to the upright position. Under this condition, the lower surface of the sheet bundle Sa is apart from the coating roller 51 of the coating section 50. Further, when the sheet bundle Sa is sandwiched between the supporting member 41 and pressing member 45, the holding plate 42 is rotated from the position of the broken line to the position of the solid line by the driving section (not illustrated).

Figure 6:
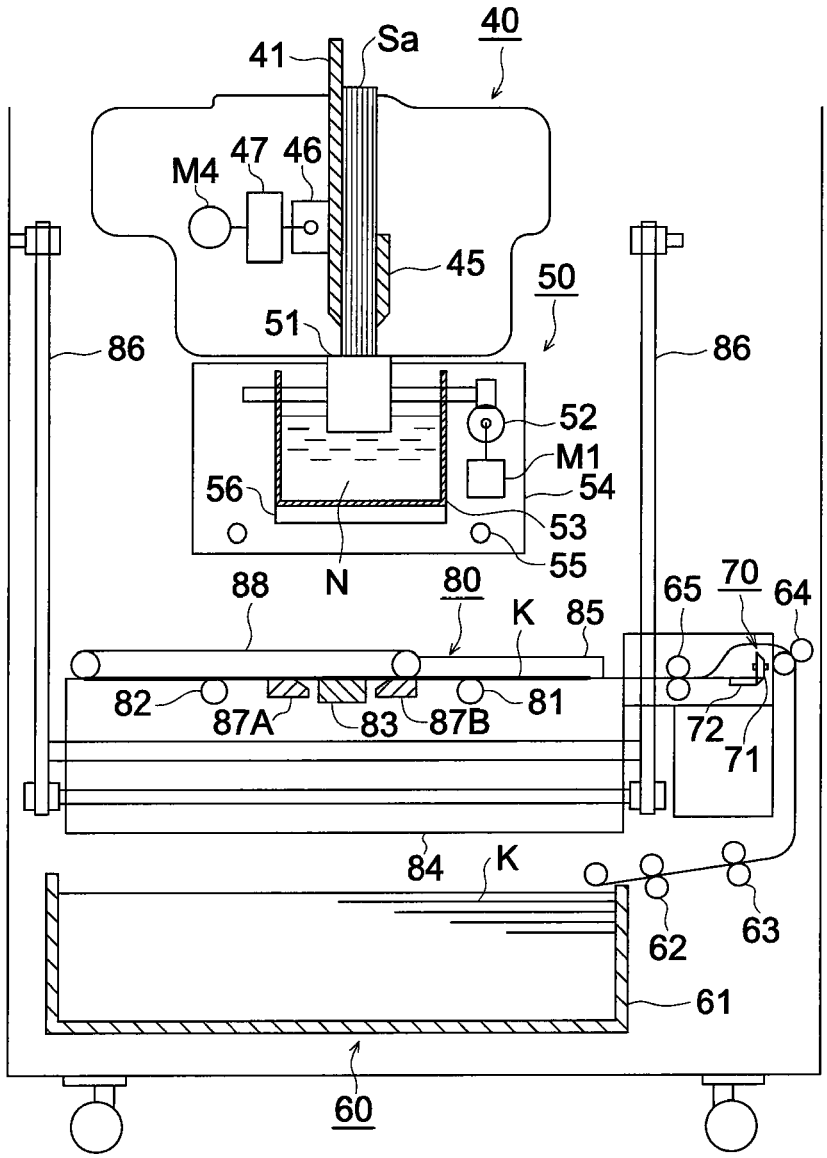
FIG. 6 is a cross sectional view showing a sheet bundle accommodating section, coating section, cover sheet supply section, cutting section, and booklet formation section.

FIG. 6 is a cross sectional view showing a sheet bundle accommodating section 40, coating section 50, cover sheet supply section 60, cutting section 70, and booklet forming section 80.

The coating section 50 includes a coating roller 51, a driving section 52 for driving the coating roller 51, an adhesive container 53 for accommodating the adhesive N such as glue, a moving member 54 that supports the adhesive container 53 and can travel from the initial position at the rear of the bookbinding apparatus B to the coating position at the front, a moving device 55 that provides reciprocating motion of the moving member 54 and a heater 56 for heating the adhesive N accommodated in the adhesive container 53.

The moving member 54 of the coating section 50 is moved by the driving section (not illustrated) in the direction parallel to the lengthwise direction of the lower surface of the sheet bundle Sa held in an upright position by the supporting member 41 and pressing member 45.

The moving member 54 starts movement from the initial position at the rear of the bookbinding apparatus B, and travels along the moving device 55 until it is stopped at a predetermined position at the front of the bookbinding apparatus B. After that, the moving member 54 is reversed to get back to the initial position.

Figure 7:
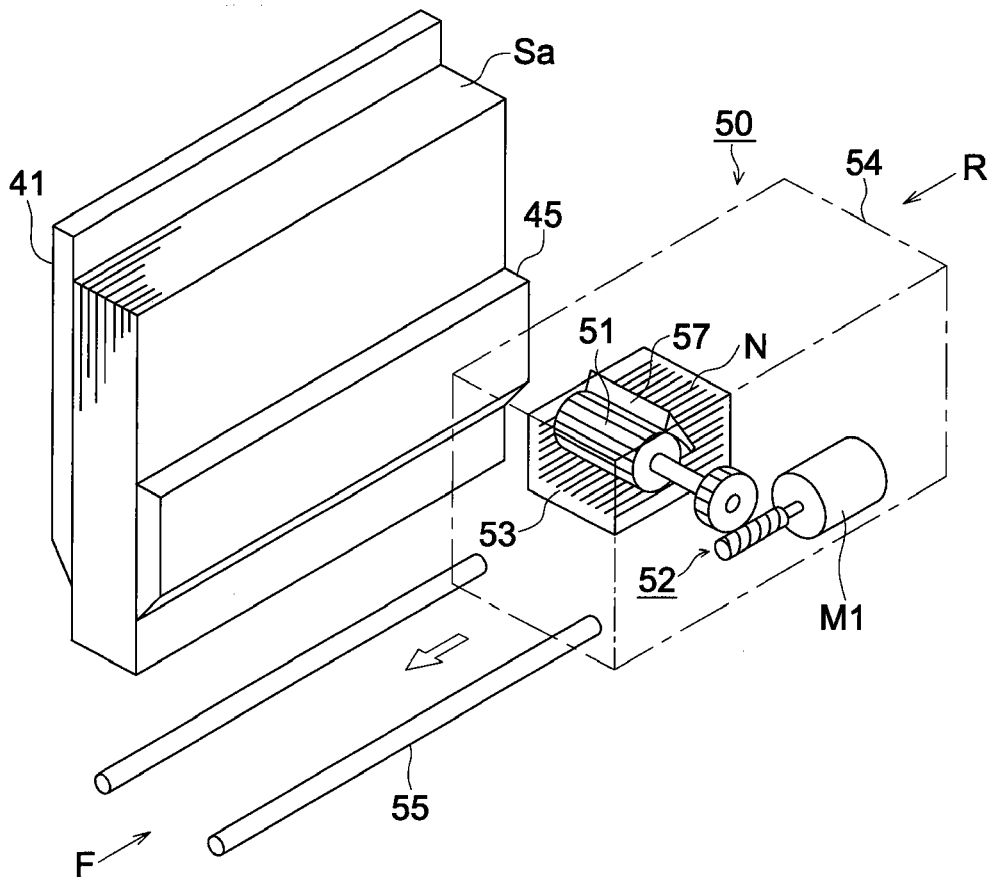
FIG. 7 is a perspective view representing the periphery of the coating section.

FIG. 7 is a perspective view representing the periphery of the coating section 50.

The coating roller 51 dipped in the adhesive container 53 accommodating the adhesive N is rotated by the motor M1 and driving section 52. The outward movement or reciprocating motion of the moving member 54 allows the coating roller 51 to apply the adhesive N on the lower surface of the sheet bundle Sa sandwiched in an upright position, along the length thereof from the rear side R toward the front side F.

The regulating member 57 regulates the thickness of the layer of adhesive N applied to the outer peripheral surface of the coating roller 51.

As shown in FIG. 6, the cover sheet K accommodated in the cover sheet stacking section 61 of the cover sheet supply section 60 is separated and fed by the sheet feed section 62. Being sandwiched by the conveyance rollers 63, 64 and 65, the cover sheet K is conveyed to the booklet forming section 80.

The cutting section 70 designed in an integrated structure with the booklet forming section 80 is located on the right of the booklet forming section 80 in the upward position of the cover sheet supply section 60 in the drawing. This cutting section 70 trims the cover sheet K along the length to a predetermined length, using the rotary cutter made up of a rotary blade 71 and stationary blade 72.

The predetermined length is obtained by adding the length of the spine of the sheet bundle Sa to the length of two sheets S in the traveling direction. For example, it is assumed that the cover sheet K is glued to the spine of the sheet bundle Sa made up of A4-sized sheets S and the folded bookbinding operation is performed and the maximum number of the sheets of the sheet bundle Sa is 300 and the thickness is about 30 mm. In this case, the predetermined length is set at 450 mm which is obtained by adding about 30 mm of the thickness of the sheet bundle Sa to two times 210 mm of short side length of the A4-sized sheet, and then the cover sheet K is trimmed (the overall length of the cover sheet K prior to trimming is 450 mm or more).

When a booklet is to be bound by the wrapping-type bookbinding operation of A5-sized, B5-sized and 8.5×11-inch (1 inch equivalent to 25.4 mm)-sized sheets S, a predetermined length is also set according to the length of the short side of the sheets and the thickness of the sheet bundle.

In the operating section 9 or external device of the image forming apparatus A, the control section sets the predetermined trimmed length of the cover sheet K, if the sheet size, number of sheets, and thickness of the sheets have been set or detected. The length of the cover sheet K prior to trimming is predetermined in response to the maximum number of sheets, and the sheets are stored in the cover sheet stacking section 61 of the cover sheet supply section 60.

The booklet forming section 80 includes conveyance rollers 81 and 82 that receive and convey the cover sheet K supplied from the cover sheet supply section 60 and stop it at a predetermined position, a pressurizing member 83 for pressing the cover sheet K against the adhesive coated surface of the sheet bundle Sa, a moving casing 84 for supporting the conveyance rollers 81 and 82 and the pressurizing member 83, an aligning section 85; and an elevating section 86 moving the moving casing 84 in the vertical direction.

The booklet forming section 80 and the booklet delivering belt 88 are shifted up and down together with each other by the elevating section 86. When the booklet forming section 80 stops at the lower position to introduce the cover sheet K therein, the aligning section 85 moves from the initial position according to the size of the cover sheet K, and applies pressure to both sides of the cover sheet K across the width prior to the trimming operation, whereby alignment along the width is performed. The cover sheet K free of skew by means of widthwise alignment is switched back in the direction opposite to the direction of introduction. The cover sheet K is then conveyed to the cutting section 70 and is trimmed at a predetermined position.

Before the booklet forming section 80 glues the trimmed cover sheet K onto the spine of the sheet bundle Sa, the aligning section 85 moves from the initial position and presses both sides of the cover sheet K along the width again, whereby widthwise alignment is achieved at the lower position. Then the cover sheet K is stopped at a predetermined position. After that, the aligning section 85 goes back to the initial position without adversely affecting the bondage between the cover sheet K and sheet bundle Sa. This is followed by the step of upward traveling of the booklet forming section 80. At the time of upward traveling, the cover sheet K is supported at a predetermined position.

Accordingly, the aligning section 85 installed on the booklet forming section 80 capable of shifting up and down determines the position of the cover sheet K across the width before and after the trimming of the cover sheet K by the cutting section 70. This procedure implements improvement of the cover sheet trimming precision, enhancement of positioning accuracy between the sheet bundle Sa and cover sheet K, and simplification of the structure.

The elevating section 86 moves the moving casing 84 to the upper position by rotating the belts on the right and left. In this upward traveling position, the center of the cover sheet K placed on the pressurizing member 83 is pressed against the surface coated with adhesive of the sheet bundle Sa, whereby the cover sheet K is glued with the sheet bundle Sa. Upon termination of the sheet bundle Sa being coated with adhesive, the coating section 50 travels backward and goes to the retracted position.

The cover sheet folding section is mounted on the top of the booklet forming section 80. The cover sheet folding section includes a pair of bilaterally symmetrical forming members 87A and 87B. The forming members 87A and 87B can be touchable and detachable with the sheet bundle Sa along the thickness of the sheet bundle Sa. The forming members 87A and 87B fold the cover sheet K along the side edge of the adhesive-coated surface of the sheet bundle Sa, and lay the front cover sheet and back cover sheet on top of the front and rear sides of the sheet bundle Sa.

Upon termination of the step of folding the cover sheet K, the booklet forming section 80 is lowered a predetermined distance by the downward drive of the elevating section 86, and is stopped after having retracted. After that, when the holding operation by the holding section has been turned off, the booklet Bk drops and the spine on the lower surface of the booklet Bk comes in contact with the top surface of the booklet ejection belt 88. The booklet Bk is placed in position and is delivered.

Figure 8A:
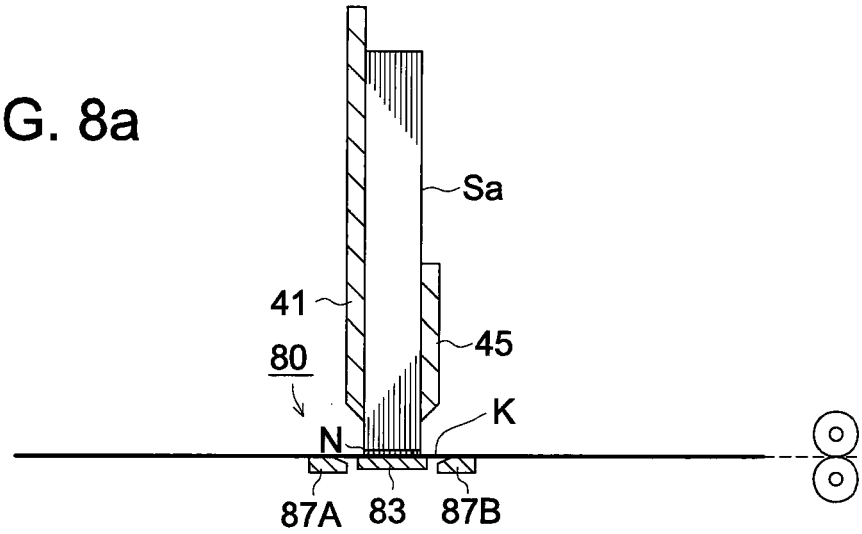
FIGS. 8*a*, 8*b*, 8*c* and 8*d* each is a cross sectional view showing the booklet formation section and sheet bundle wherein the cover sheet folding process is illustrated.
Figure 8B:
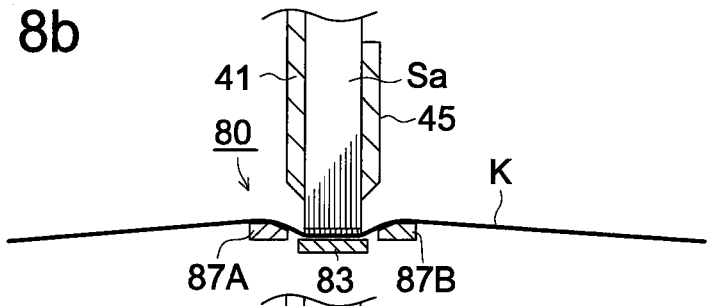
Figure 8C:
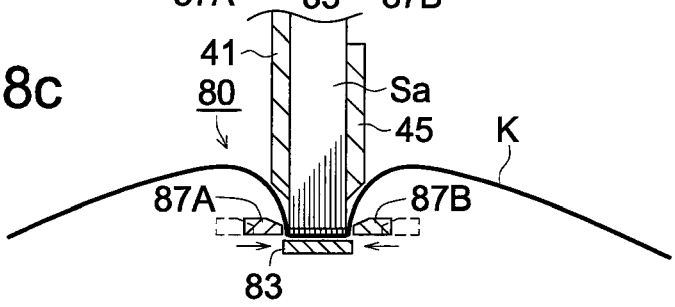
Figure 8D:
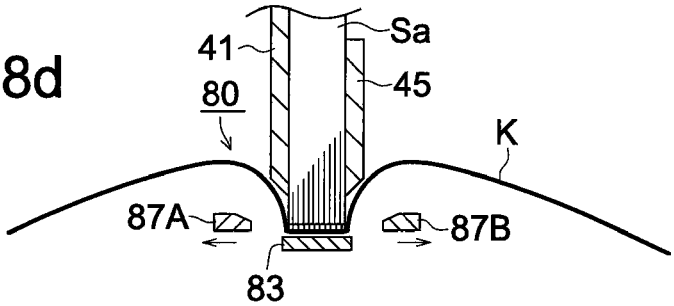

Each of FIGS. 8*a*, 8*b*, 8*c* and 8*d* is a cross sectional view showing the booklet forming section 80 and sheet bundle Sa, and illustrates the cover sheet K folding process. FIG. 8*a* shows the start of the operation of folding the cover sheet. FIG. 8*b* shows the process of the cover sheet being folded. FIG. 8*c* shows the termination of the folding operation. FIG. 8*d* shows that the cover sheet folding pressure has been turned off.

Figure 9A:
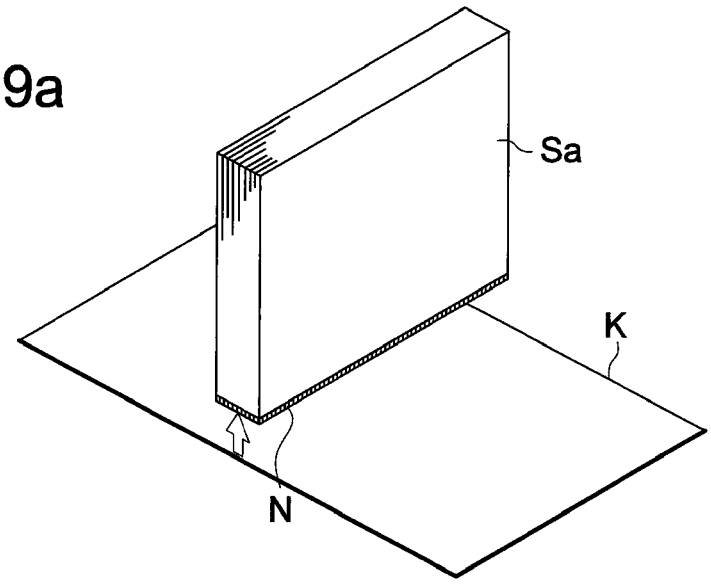
FIGS. 9*a*, 9*b* and 9*c* each is a perspective view representing the booklet binding process using the sheet bundle and cover sheet.
Figure 9B:
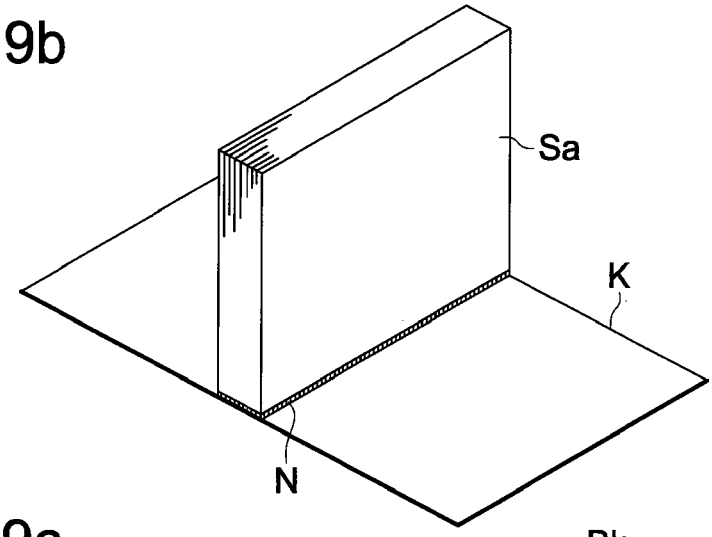
Figure 9C:
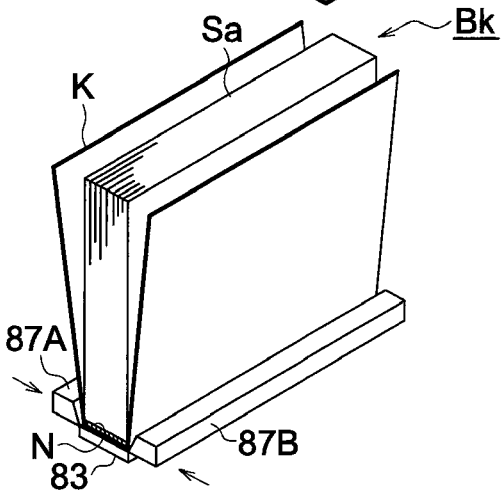

Each of FIGS. 9*a*-9*c* is a perspective view representing a booklet Bk binding process using the sheet bundle Sa and cover sheet K. FIG. 9*a* is a perspective view representing a cover sheet K and sheet bundle Sa before the cover sheet is glued. FIG. 9*b* is a perspective view showing a sheet bundle Sa with cover sheet K glued thereon. FIG. 9*c* is a perspective view representing a booklet Bk produced by wrapping a sheet bundle Sa with a folded cover sheet K.

After the cover sheet K is glued onto the sheet bundle Sa coated with adhesive N, the forming members 87A and 87B are driven by a driving section (not illustrated) when the booklet forming section 80 is located at the upward position as shown in FIGS. 8*a*-8*d*. The cover sheet K is sandwiched between the forming members 87A and 87B, and is deformed from the side edge of the adhesive-coated surface of the sheet bundle Sa (refer FIG. 8*b*). After that, the forming members 87A and 87B move in the horizontal direction toward the adhesive-coated surface of the sheet bundle Sa, and form the cover sheet K by pressing both sides of the sheet bundle Sa, whereby the booklet Bk is produced.

[Outline of a Notch Forming Unit]

In order to strengthen adhesive strength between a sheet bundle Sa and a cover sheet K, notch grooves Va (refer to FIGS. 13*a* through 13*c*) constituted by notches V (refer to FIGS. 11*a* through 11*d*) are formed on the spine of a sheet bundle Sa.

Figure 10:
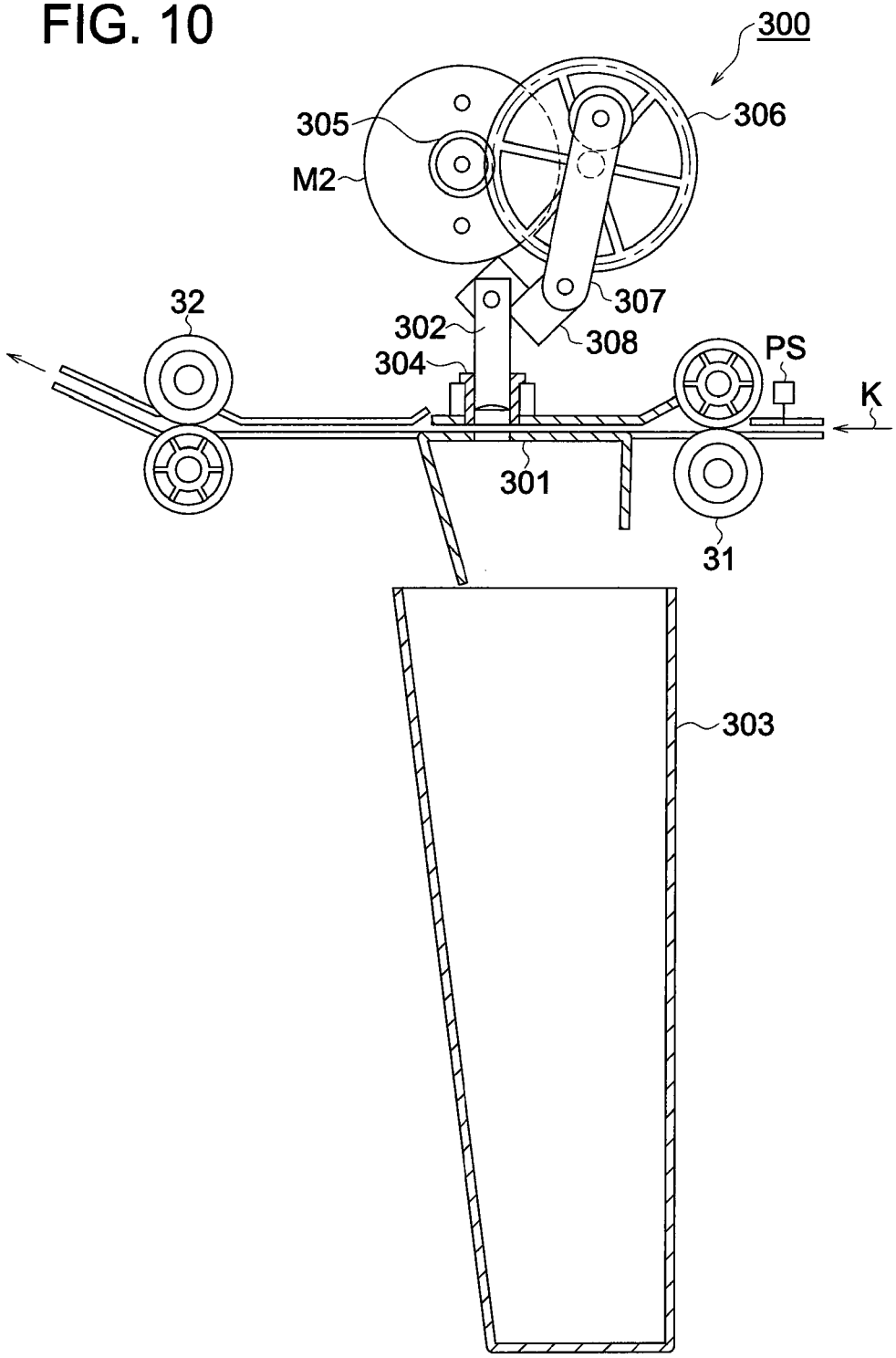
FIG. 10 is a cross sectional view of a notch forming section.

FIG. 10 is a cross sectional view of a notch forming unit 300. The notch forming unit 300 includes a die 301 fixed on the conveying path of sheet S, a punch 302 moving upward to fit into the die 301, a driving section for providing vertical traveling of the punch 302, and a sheet scrap container 303 for accommodating the sheet scrap generated at the time of notch processing.

The outer peripheral surface of the punch 302 opposed to the die 301 is fitted to the inner surface of the guide member 304 movably in the vertical direction. The driving section for providing vertical traveling of the punch 302 includes a motor M2; a small gear 305 connected with the motor M2; a large gear 306 meshing with the small gear 305; a crank 307 engaged to one edge of the large gear 306 and capable of rocking; and a connecting member 308 for connection between the crank 307 and the upper portion of the punch 302. The punch 302 is driven in the vertical direction by the motor M2 through the small gear 305, large gear 306, crank 307 and connecting member 308. When the punch 302 is shifted downward and fits with the die 301, notches V are formed on the trailing edge of the sheets S.

Each of FIGS. 11*a*-11*d* is a plane view showing the sheet containing notches and perforations formed thereon.

Figure 11A:
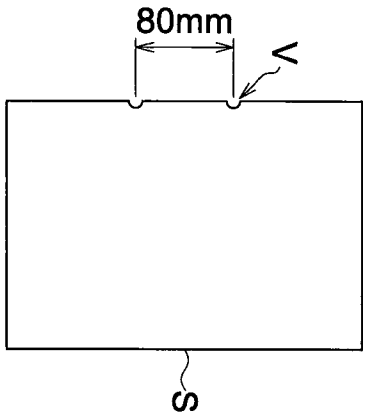
FIGS. 11*a*, 11*b*, 11*c* and 11*d* each is a plane view showing the sheet containing notches and perforations formed thereon.
Figure 11C:
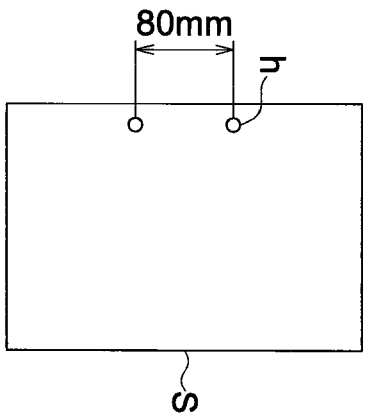
Figure 11B:
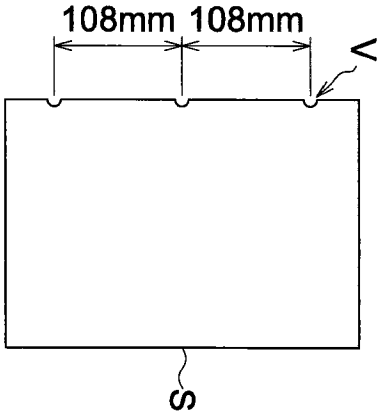

The shape of notches V is made like a capital V or U, in addition to a semicircle shown in FIGS. 11*a* and 11*b*. For example, the notch V can be formed by a punch and die commonly used for sheet files.

The numbers of the notches V and perforations "h" formed on the sheet S can be set as desired, by adjusting the numbers of the punches and dies. Two notches V of FIG. 11*a* have a hole diameter of ϕ6 mm and a space of ϕ80 mm between the holes. Three notches V of FIG. 11*b* have a hole diameter of ϕ6 mm and a space of ϕ108 mm between the holes. Two circular perforations "h" of FIG. 11*c* have a hole diameter of ϕ6 mm and a space of ϕ80 mm between the holes. The three perforations "h" of FIG. 11*d* have a hole diameter of ϕ6 mm and a space of ϕ108 mm between the holes.

In the operating section 9 of the image forming apparatus A, when the perforation processing and notch processing are not set, each of the sheets S delivered from the image forming apparatus A passes through the notch forming unit 300 without being processed, and the sheets S are coated with adhesive.

In the operating section 9, when notch processing for forming notches V is set, the trailing edge of each of the sheets S is detected by the sensor PS (FIG. 10). After that, the pulses more than the predetermined pulses at the time of punching out the perforation "h" are counted and the sheet S is conveyed and stopped. After that, notches V are formed close to the trailing edges of the sheets S (FIGS. 11*a* and 11*b*).

Figure 11D:
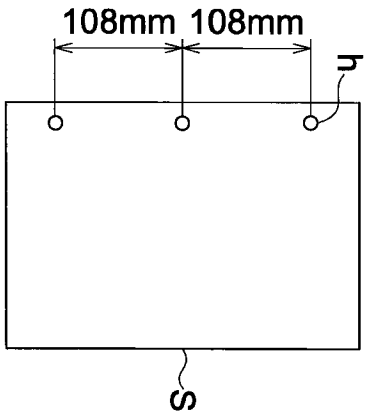

In the operating section 9, when the perforation processing for punching the circular perforation "h" is set, the sensor PS (FIG. 10 or FIG. 12) detects that the trailing edge of each of the sheets S sandwiched and conveyed by the conveyance roller 31 and conveyance roller 32 has passed. Then the predetermined pulses are counted, the motor for the sheet conveyance (not illustrated) is stopped, whereby the feeding of the sheet S is stopped. Perforations "h" are formed close to the trailing edges of the sheets S where the sheet has stopped (FIGS. 11*c* and 11*d*).

Figure 12:
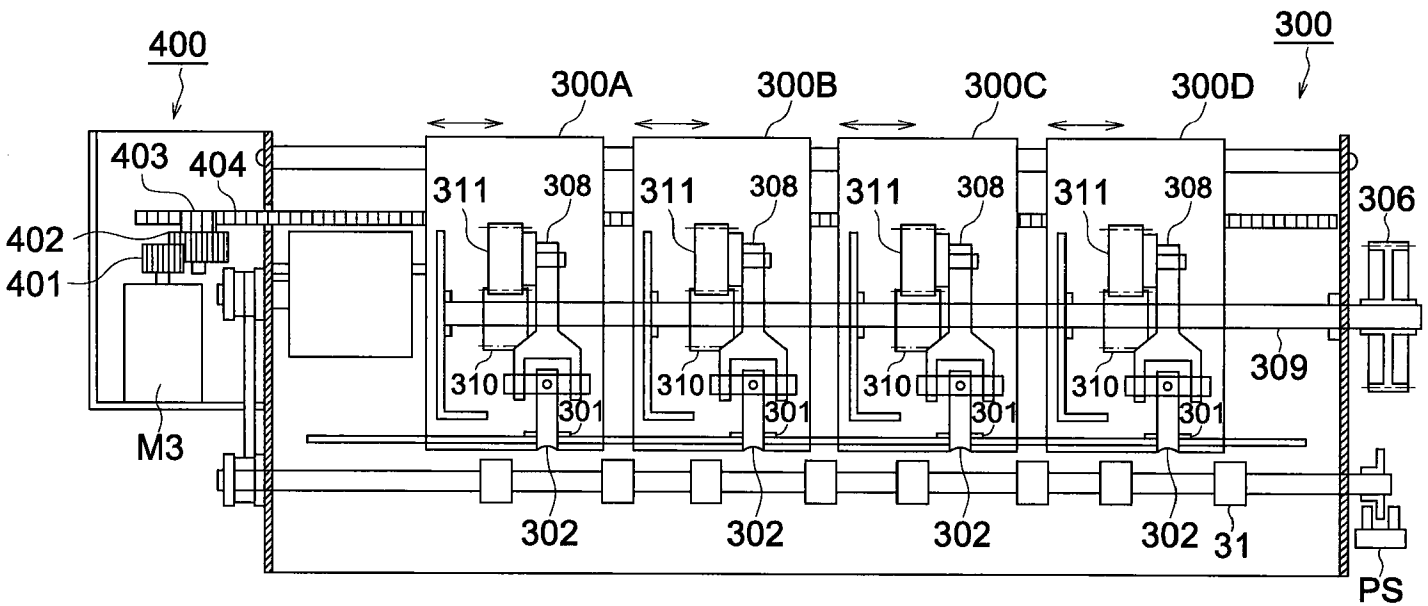
FIG. 12 is a front view of a notch forming section and shifting section.

FIG. 12 is a front view of a notch forming unit 300 and shifting section 400.

The shifting section 400 moves the notch forming sections 300A, 300B, 300C and 300D each having a punch 302 and die 301 in the lateral (right and left) direction of FIG. 12 (in the horizontal direction perpendicular to the direction wherein the sheet S is conveyed). The positions of the notches V formed on the sheet S are changed by the lateral traveling of the notch forming sections 300A, 300B, 300C and 300D.

If the motor M3 is driven, the rack gear 404 moves in the lateral direction of FIG. 12 through the gear train made up of gears 401, 402 and 403. Rack gear 404 is engaged with the notch forming sections 300A, 300B, 300C and 300D, and the notch forming sections 300A, 300B, 300C and 300D are moved in the lateral direction (FIG. 12) by the traveling of the rack gear 404. In FIG. 12, four notch forming sections are illustrated, a desired number of notch forming sections can be installed in conformance to the number of the notches or perforations to be provided on the sheet S. Further, in the present embodiment, the notch forming device is composed of the post-processing control section 200, notch forming sections 300A, 300B, 300C and 300D, and shifting section 400.

[Outline of Notch Grooves]

Figure 13A:
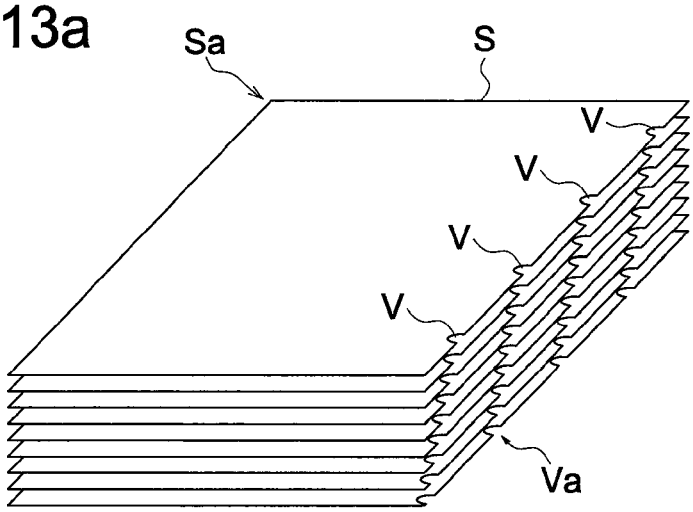
FIGS. 13*a*, 13*b* and 13*c* are a perspective view, front view, and partially enlarged view representing the sheet bundle consisting of the sheets containing notches.
Figure 13B:
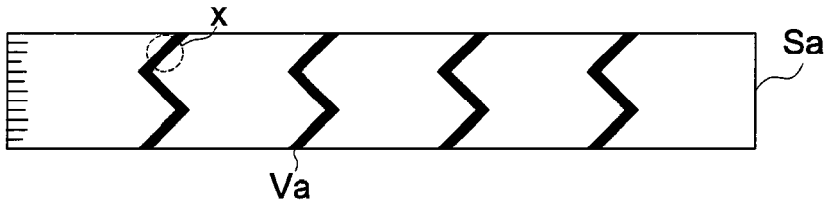
Figure 13C:
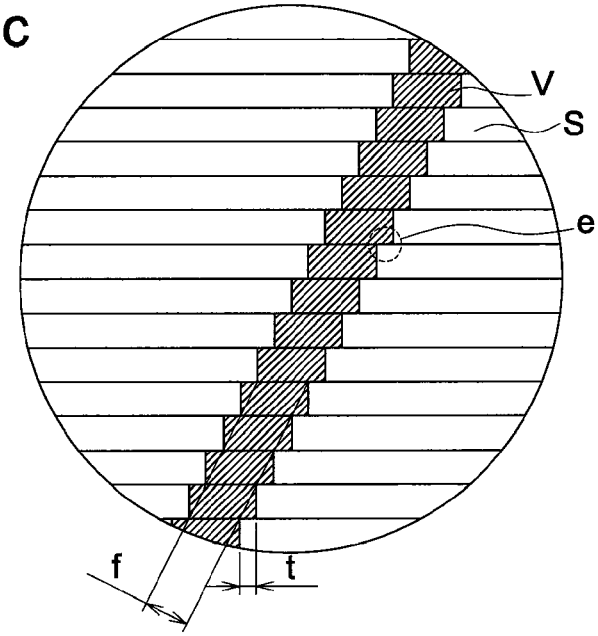

FIG. 13*a* is a perspective view showing the sheet bundle Sa formed of the sheets S having notches V. FIG. 13*b* is a front view of the spine of the sheet bundle Sa. FIG. 13*c* is a partially enlarged view of the spine of the sheet bundle Sa.

As shown in FIG. 13*a*, four notches V are formed on the edge of each sheet S. The sheets S including notches V are stacked in a sheet bundle Sa, and then notch grooves Va are formed on the spine of the sheet bundle Sa. As shown in FIG. 13*b*, four notch grooves Va are formed on the spine of the sheet bundle Sa (the shape of notch grooves in FIG. 13*a* is different from the shape of notch grooves in FIG. 13*b*). Four notch grooves Va are formed approximately at equally spaced intervals to form a surface to be filled with adhesive. In this state, the spine of the sheet bundle Sa is coated with adhesive N by the coating section 50 of FIG. 5. The adhesive N is applied to the spine and enters the notch grooves Va, whereby an adhesive surface is formed.

Entry of the adhesive into the notch grooves Va formed on the spine of the sheet bundle Sa increases the adhesive strength on the spine of the sheet bundle Sa. This prevents the sheets S that have insufficient adhesive strength from falling out of the booklet Bk produced by gluing the cover sheet K to the sheet bundle Sa when the booklet is open.

The notch grooves Va shown in FIG. 13*b* are made in a zigzag bent shape. As shown in FIG. 13*c* in which the "x" region shown in FIG. 13*b* is enlarged, the position of a notch is shifted in the horizontal direction for each sheet. When the positions of the notches V are shifted for each sheet, adhesive adheres the shifted or displaced portion (the area "e" in FIG. 13*c*), whereby adhesive strength between the sheets is enhanced.

As shown in FIG. 13*c*, the positions of notches V are changed for each sheet by a shifting distance "t". The width of the notch grooves Va formed by the notches V is represented by "f" in FIG. 13*c*. The amount of the adhesive entering the notch grooves Va differs according to the width f of the notch grooves Va, and therefore, it is preferred that the shifting distance "t" should be adjustable.

As shown in FIGS. 13*a*-13*c*, to change the position of the notches V for each sheet in the horizontal direction, the post-processing control section 200 controls the operation of the shifting section 400 in such a way that the notch forming sections 300A, 300B, 300C, and 300D are moved in the horizontal direction for each sheet. Further, as shown in FIG. 13*c*, enhanced adhesive strength can be obtained by changing the position of the notches V for every sheet. However, to simplify the control procedure, the position of the notches V can be changed every plural sheets (e.g., every two sheets).

[Control Operation to Form Notch Grooves]

Here, when a booklet is produced with a thin cover sheet, since a cover sheet on the spine of a booklet becomes almost transparent, the shape of notch grooves Va may be recognized through the cover sheet as shown in FIG. 13*b*. In the case of producing plural booklets continuously on the above situation, if the shape of notch grooves Va is not coincident among the plural booklets, the appearance of them is no good. Then, in the case of producing (outputting) plural booklets, the notch positions of the leading page in the sheet bundle Sa of each booklet is made to the same position in such a way that the shape of notch grooves Va becomes coincident among the plural booklets. Hereafter, an operation to make a notch position to the same position is explained with reference to FIG. 14.

Figure 14:
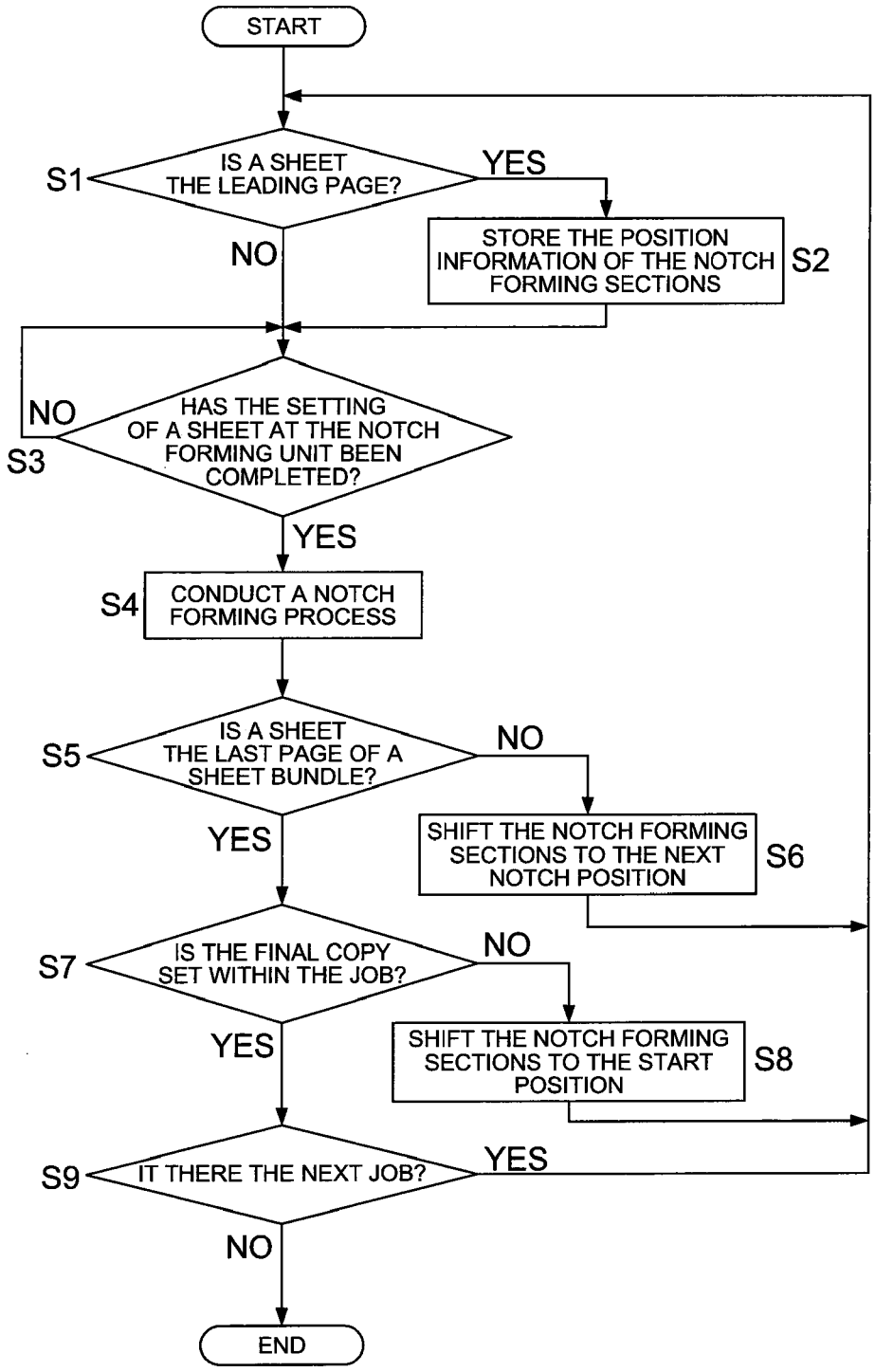
FIG. 14 is a flow chart diagram showing an operation to make the notch positions of the leading page in a sheet bundle to the same positions.

FIG. 14 is a flow chart diagram showing an operation to make the notch positions of the leading page of a sheet bundle Sa to the same position. The judging step (Steps S1, S3, S5, S7, S9) in FIG. 14 is executed in a post processing control section 200 in the bookbinding apparatus B.

First, when a job to produce a booklet in a binding system is started, before sheets S are fed from the seat storage section 7A in the image forming apparatus A, the information regarding the sheets S is transmitted for each sheet from the image forming apparatus A to the bookbinding apparatus B. When the bookbinding apparatus B receives the information regarding the sheets S, the bookbinding apparatus B judges whether a sheet S in the received information is the leading page of a sheet bundle Sa (Step S1). If the bookbinding apparatus B judges that a sheet S in the received information is the leading page of the sheet bundle Sa (Step S1; Yes), the bookbinding apparatus B memorizes the position information at present on the notch forming sections 300A, 300B, 300C, and 300D (refer to FIG. 12) to form notches V in a sheet S (Step S2). The position information memorized at step S2 is memorized as initial position information of the notch forming process, and for example, is memorized by a RAM (not illustrated in any drawing) in the image forming apparatus A or the bookbinding apparatus B. Further, the position information may be position information on a predetermined coordinate axes, distance information from the edge face of a sheet S, and the like.

Next, the bookbinding apparatus B judges whether or not an operation to convey a sheet S in the received information from the image forming apparatus A and to set the sheet at the notch forming unit 300 in order to form notches V has been completed (Step S3). If the bookbinding apparatus B judges such that the setting operation has been completed, a notch forming process is conducted by the notch forming sections 300A, 300B, 300C, and 300D (Step S4). Whether or not the operation to set the sheet S at the notch forming unit 300 has been completed is judged in such a manner that after a sensor PS detects the trailing end of the conveyed sheet S (refer FIG. 10), the bookbinding apparatus B judges by counting predetermined pulses whether or not the sheet S stops.

When the notch forming process in Step S4 is conducted, successively, the bookbinding apparatus B judges whether or not the sheet S on which the notch forming process has been conducted is the last page of the sheet bundle Sa (Step S5). As a result, if it is judged that the sheet S is not the last page of the sheet bundle Sa (Step 55; No), the shifting section 400 shifts the notch forming sections 300A, 300B, 300C, and 300D to notch positions at which the notch forming process is conducted to the following sheet S (Step S6). At this time, the shifting distance and the shifting direction of the notch forming sections 300A, 300B, 300C, and 300D are determined from a predetermined table stored in a RAM of the bookbinding apparatus B. Therefore, with reference to the predetermined table, the post processing control section 200 in the bookbinding apparatus B controls the shifting section 400 by a predetermined program. Here, the shifting distance and the shifting direction of the notch forming sections 300A, 300B, 300C, and 300D may be set freely by a user or an optimum table may be selected in accordance with the content of a job to be conducted.

Alternately, if it is judged that the sheet S is the last page of the sheet bundle Sa in Step S5 (this means that the judgment here has detected the last page of the sheet bundle), the bookbinding apparatus B judges whether the booklet produced by the sheet bundle Sa containing the judged sheet S is the last copy set within the job (Step S7). The judging operation in Step S7 is conducted based on the attribute information on the job read from the image forming apparatus A.

When it is judged that the booklet is not the last copy set within the job in Step S7 (Step S7; No), a booklet of the following copy set is successively produced in the same job. Then, with reference to the position information memorized in Step S2, the notch forming sections 300A, 300B, 300C, and 300D are shifted to the starting position (positions at which the notch forming process was conducted to the leading page of the sheet bundle Sa) of the notch forming process (Step S8). Then, the operation returns to Step S1, the following operations are repeated, whereby the operations of the notch forming process are conducted to sheets S constituting the following sheet bundle Sa.

With the operation to shift the notch forming sections 300A, 300B, 300C, and 300D to the starting position of the notch forming process in step S8, the positions of notches V formed on the leading page of the following sheet bundle Sa can be made as the same positions as those of the leading page of the previous sheet bundle Sa. Further, with the operations conducted after Step S1, notch grooves Va in the same shape as the notch grooves Va formed in the previous sheet bundle Sa can be formed in the following sheet bundle Sa.

At Step S7, it is judged that the booklet is the last copy set within the job (Step S7; Yes), the bookbinding apparatus B judges whether or not there is the following job (Step S9), and when there is the following job (Step S9; Yes), the operation returns to Step S1, and the following operations are continued. Here, the starting position information of the notch forming process is not memorized in Step S2, alternately, the home positions of the notch forming sections 300A, 300B, 300C, and 300D may be predetermined. With this structure, when notches V are formed on the leading page of a sheet bundle Sa, the notch forming sections 300A, 300B, 300C, and 300D may be shifted to the respective home positions, and are operated to form notches V on the home positions. Further, although the notch forming sections 300A, 300B, 300C, and 300D are shifted for every one sheet as shown in FIG. 14, these notch forming sections may be shifted for every plural sheets.

Figure 15A:
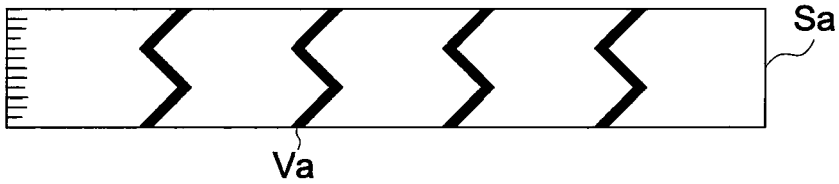
FIGS. 15*a* to 15*c* each is an explanatory diagram showing a shape of notch grooves in plural sheet bundles.
Figure 15B:
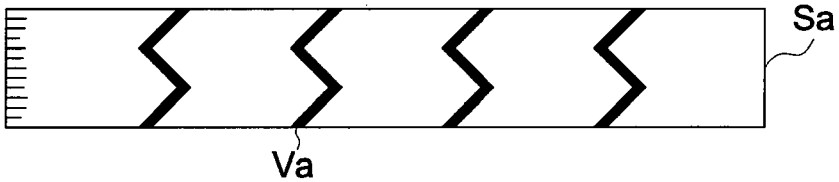
Figure 15C:
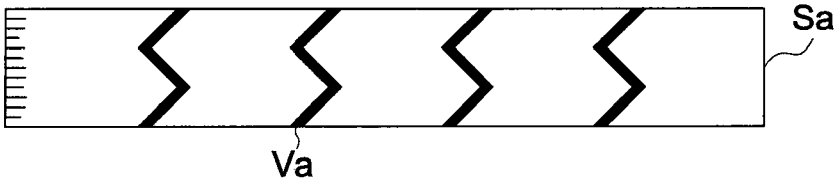

When the operations as shown in FIG. 14 are conducted to produce booklets continuously, sheet bundles Sa constituting each produced booklet are configured as a form shown in FIGS. 15*a* through 15*c*. The sheet bundle Sa shown in FIG. 15*a* is the sheet bundle constituting a booklet of the first copy set, the sheet bundle Sa shown in FIG. 15*b* is the sheet bundle constituting a booklet of the second copy set, and the sheet bundle Sa shown in FIG. 15*c* is a sheet bundle constituting a booklet of the third copy set. Further, the sheet of the leading page is located in the lowermost position in each sheet bundle Sa, and the sheet of the last page is located in the uppermost position.

As shown in FIGS. 15*a* through 15*c*, the notch positions on the leading page in each sheet bundle Sa are made to the same positions. Since each of the notch grooves Va in the zigzag bent shape starts from the notch positions of the leading page, when the notch positions on the leading page are made to the same positions, the notch grooves Va formed in each sheet bundle Sa are made in the same shape.

Thus, by the technique to make the notch positions on the leading page in each sheet bundle Sa to the same positions so as to make the shape of notch grooves Va into the same shape, even if a booklet is produced with a thin cover sheet and notch grooves Va are recognized through the thin cover sheet, the notch grooves Va are aligned in good order among the plural booklets, whereby the appearance among the plural booklets can be made good. Further, even in the case that a booklet is merely made such that a sheet bundle Sa is not made to be attached with a cover sheet, only the spine of a sheet bundle Sa is coated with an adhesive, and notch grooves Va are directly observed, the appearance of the booklet can be made good. Furthermore, among the plural booklets, locations on the spine of a sheet bundle Sa on which a large amount of adhesive is adhered can be made to the same locations, whereby an adhesive force between a sheet bundle and a cover sheet can be made the same adhesive force among the plural booklets.

[Control Operations with Reference to Conveyance Interval of Sheets S]

As explained in FIG. 14, in the case of producing plural booklets continuously, the notch positions on the leading page in each sheet bundle Sa are made the same positions. In this case, in order to form notches V on the leading page of the following sheet bundle sa after notches V were formed on the last page of the previous sheet bundle Sa, it is necessary to shift the notch forming sections 300A, 300B, 300C, and 300D to the notch positions of the leading page. That is, a predetermined time period is needed from the time that notches V were formed on the last page of the previous sheet bundle Sa to the time that the preparation to form notches V on the leading page of the following sheet bundle Sa will be completed.

However, since the notch forming sections 300A, 300B, 300C, and 300D take a long time for shifting, if the leading page of the following sheet bundle Sa is conveyed to the notch forming unit 300 before the shifting of the notch forming sections 300A, 300B, 300C, and 300D has been completed, the sheet of the following page may be conveyed before the notch forming process for the leading page has been completed. Therefore, a problem may occur such that the sheet S of the following page may come in contact with the sheet of the leading page.

Then, an adjusting time period until the notch forming sections 300A, 300B, 300C, and 300D has been shifted to the respective notch positions of the leading page is calculated, and the conveyance interval among sheets S is adjusted based on the calculating result. This adjusting operation is explained with reference to FIG. 16 in view of a receivable time of the seat placing board 35.

Figure 16:
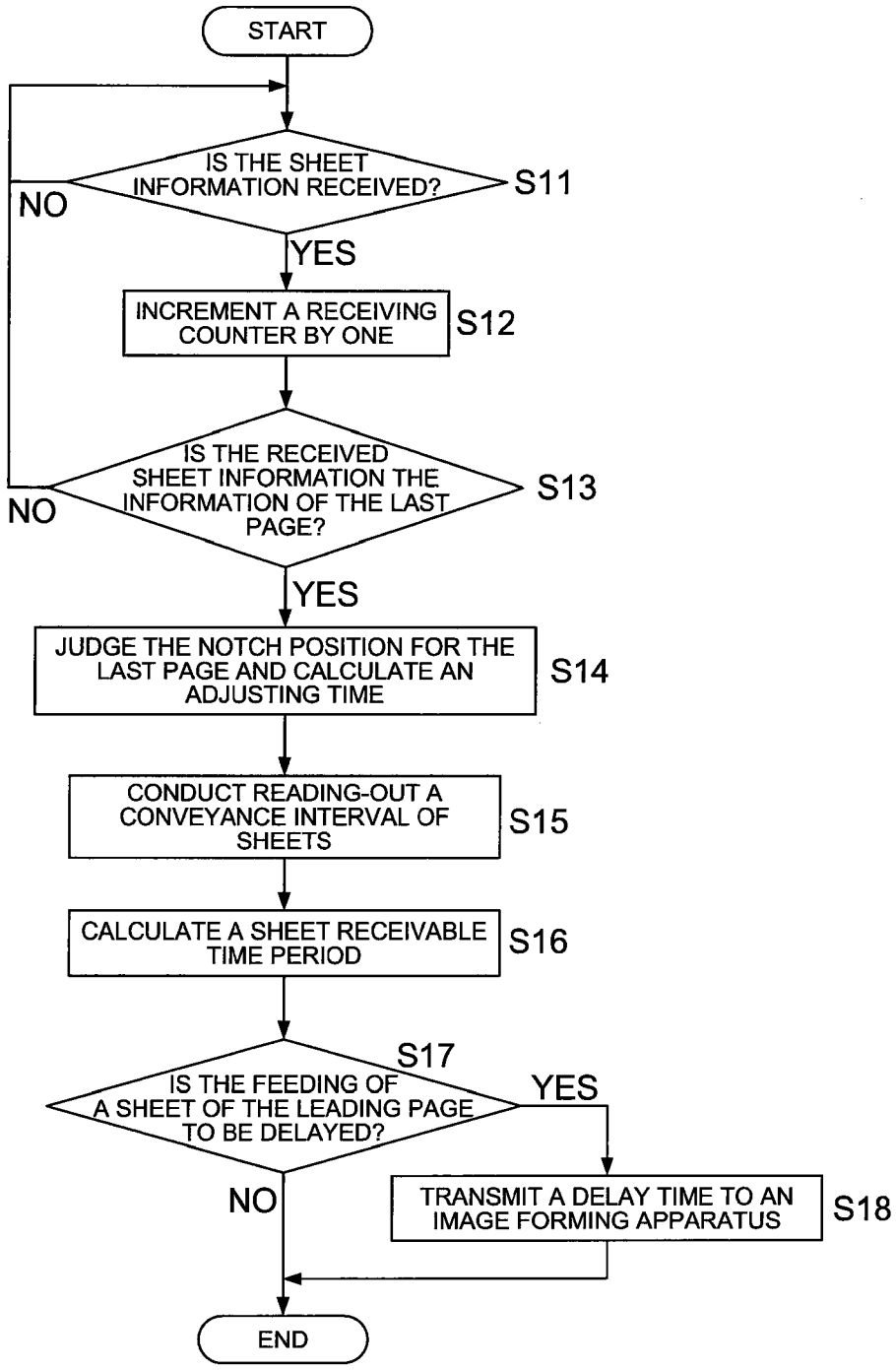
FIG. 16 is a flow chart diagram showing an operation to adjust a conveyance interval of sheets S.
Figure 17A:
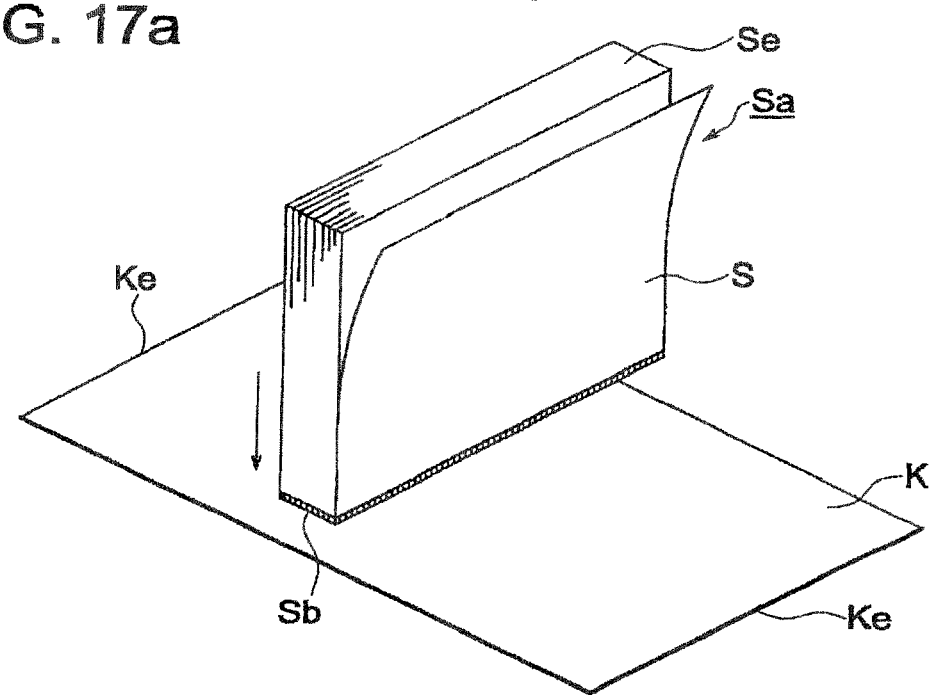
PRIOR ART FIG. 17a
FIGS. 17*a* and 17*b* each is a perspective diagram showing a booklet constituted with a sheet bundle and a cover sheet.
Figure 17B:
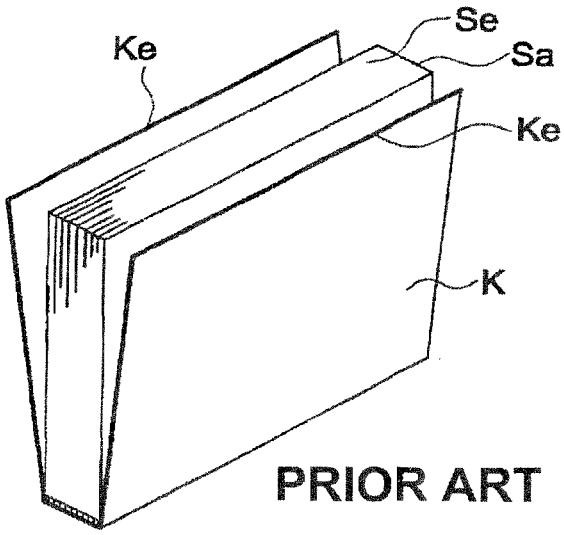
Figure 18:
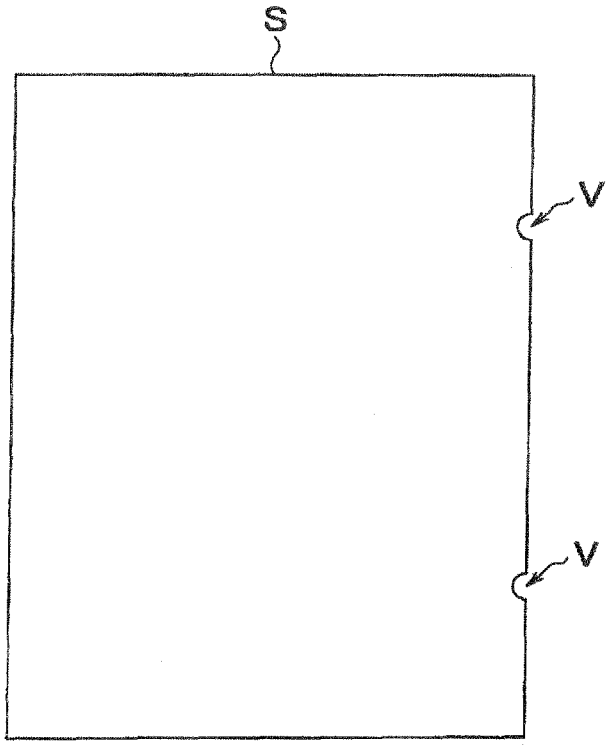
FIG. 18 PRIOR ART
FIG. 18 is a perspective diagram showing a sheet bundle on which notches are formed.
Figure 19A:
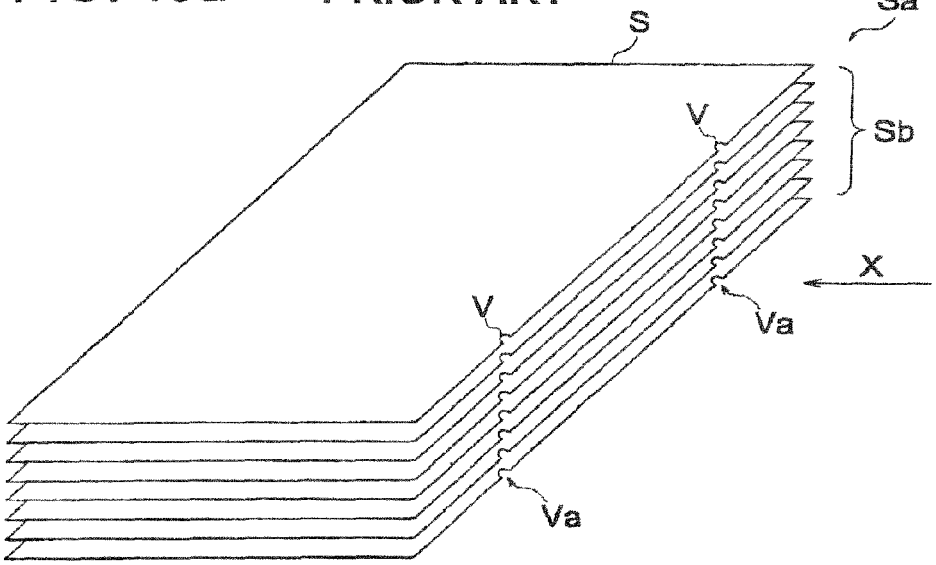
FIG. 19a PRIOR ART
FIGS. 19*a* and 19*b* each is an explanatory diagram showing a shape of notch grooves formed on the spine of a sheet bundle.
Figure 19B:
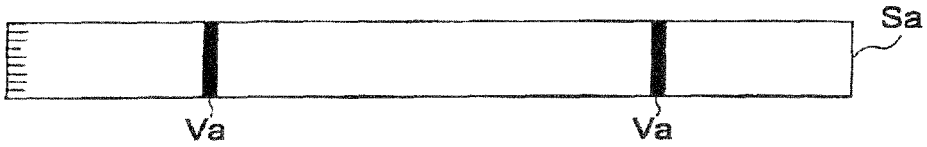
FIG. 19b PRIOR ART
Figure 20A:
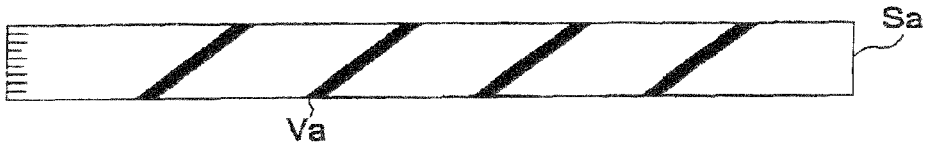
FIG. 20a PRIOR ART
FIGS. 20*a* and 20*b* each is an explanatory diagram showing a shape of notch grooves formed on the spine of a sheet bundle.
Figure 20B:
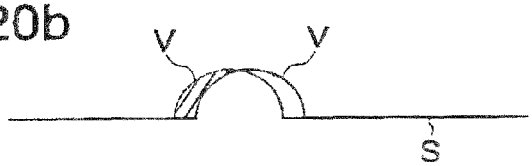
Figure 21A:
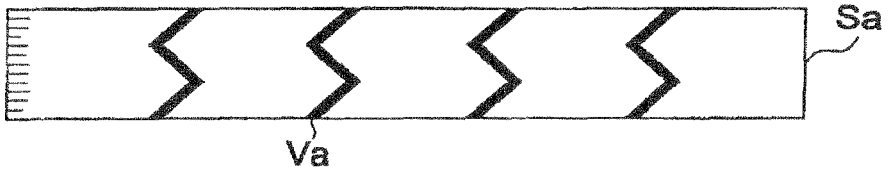
FIG. 21a PRIOR ART
FIGS. 21*a* to 21*c* is an explanatory diagram showing a shape of notch grooves on plural sheet bundles.
Figure 21B:
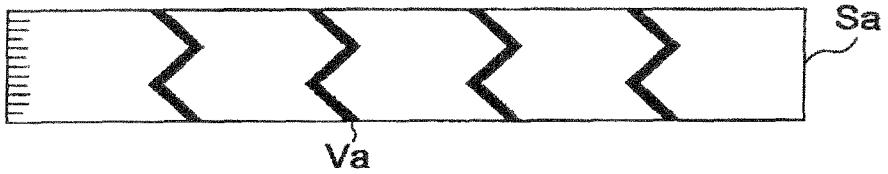
FIG. 21b PRIOR ART
Figure 21C:
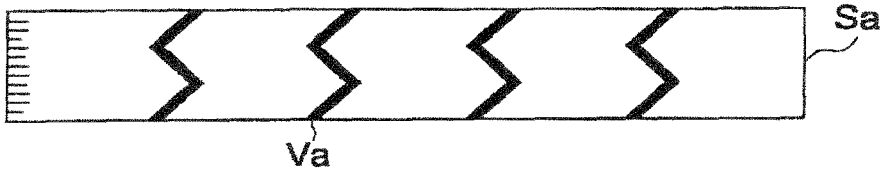
FIG. 21c PRIOR ART

FIG. 16 is a flow chart diagram showing operations to adjust the conveyance interval among sheets S. The judging steps (Steps S11, S13, S17) in FIG. 16 are conducted in the post processing control section 200 in the bookbinding apparatus B.

First, when a job to produce a booklet in a binding system is started, before sheets S are fed from the seat storage section 7A in the image forming apparatus A, the information regarding the sheets S is transmitted for each sheet from the image forming apparatus A to the bookbinding apparatus B. The bookbinding apparatus B judges whether or not the seat information has been received (Step S11). If it is judged that the seat information has been received, a receiving counter (not illustrated in any drawing) provided in the bookbinding apparatus B is made to increment its counter by one (Step S12), the bookbinding apparatus B judges whether or not the received sheet information is information of the last page of the sheet bundle Sa (Step S13).

If it is judged that the received sheet information is information of the last page of the sheet bundle Sa (Step S13; Yes), in order to judge whether or not the feeding timing of the leading page in the following sheet bundle Sa is to be delayed, the calculating operation for a required value of time is started (Steps S14 to S16).

First, the bookbinding apparatus B judges the notch positions to be formed on the last page and calculates the time (adjusting time) to shift the notch forming sections 300A, 300B, 300C, and 300D from the notch positions of the last page to the notch positions of the leading page of the following sheet bundle Sa (Step S14).

At the time stage of step S14, only the seat information of the last page is received, and the notch forming process for all sheets S constituting the sheet bundle Sa containing the last page has not been completed. Therefore, first at step S14, the bookbinding apparatus B judges the notch positions to be formed on the last page. The judgment for the notch positions to be formed on the last page is conducted in such a way that the value of the number of remaining sheets to be applied with the notch forming process (the value obtained by subtracting the count value having been applied with the notch forming process from the count value of the receiving counter having been counted at Step S12) is multiplied with the shifting distance of the notch forming sections 300A, 300B, 300C, and 300D for each sheet so as to obtain a multiplied value (total distance to be shifted) and the multiplied value is added with respective positional information of the notch forming sections 300A, 300B, 300C, and 300D at the time of the judgment.

Next, the adjusting time period is calculated. Here, the adjusting time period is calculated in such a way that a difference between the judged notch positions to be formed on a sheet of the last page and the start position of the notch forming process is multiplied with a shifting speed of the notch forming sections 300A, 300B, 300C, and 300D.

After the adjusting time period is calculated at Step S14, subsequently, a reading operation to read conveyance interval information (time) of sheets S is conducted (Step S15). Since the interval information (time) of sheets S is stored in a RAM in the image forming apparatus, the bookbinding apparatus B reads the interval information (time) of sheets S from the RAM.

Next, a sheet receivable time at the sheet placing base 35 is calculated (Step S16). The seat placing board 35 in the bookbinding apparatus B cannot receive the following sheets after receiving the last page of a sheet bundle Sa and then passing the sheet bundle Sa to a sheet bundle accommodating section 40 until completing the preparation to receive the following sheets. Then, with the consideration for the time period until the seat placing board 35 becomes the condition capable of receiving the following sheets, the bookbinding apparatus B judges whether a sheet feeding timing for the leading page of the following sheet bundle Sa is to be delayed. This seat receivable time is a time period until the preparation to receive the following sheets has been completed after the sheet S of the last page has been received to the sheet placing base 35.

After the bookbinding apparatus B has acquired the necessary values in Steps from S14 to S16, the bookbinding apparatus B judges whether or not it is necessary to delay feeding of a sheet of the leading page of the following sheet bundle Sa (Step S17). This judging operation is conducted by the following steps of comparing the adjusting time period calculated at Step S14 with the seat receivable time calculated at Step S16, judging which one is longer, and comparing the longer time with the conveyance interval (time) of sheets S read at Step S15.

In the case that the conveyance interval (time) of sheets S read at Step S15 is longer, since it is not necessary to extend the conveyance interval of sheets S, feeding of a sheet of the leading page is not delayed. On the other hand, in the case that the conveyance interval (time) of sheets S read at Step S15 is shorter, since it is necessary to extend the conveyance interval of sheets S, feeding of a sheet of the leading page is delayed.

Thus, the judgment is made in such a way at Step S15, in the case that it is judged that feeding of a sheet of the leading page is to be delayed (Step S17), the delay time is transmitted to the image forming apparatus, and the conveyance interval of sheets S is adjusted.

As mentioned above, with the steps of computing the adjusting time period to shift the notch forming sections 300A, 300B, 300C, and 300D to the notch positions of the leading page and adjusting the conveyance interval of sheets S, the notch forming process can be conducted properly without causing the contact among sheets.

It should be noted that the present invention is not restricted to the present embodiments. The present invention includes appropriate modifications or additions, without departing from the technological spirit of the invention claimed.

In the arrangement of FIG. 12, the shifting section 400 is adapted to shift the notch forming sections 300A, 300B, 300C and 300D for sheets S. However, the shifting section 400 may be adapted to shift sheets S for the notch forming sections 300A, 300B, 300C and 300D so as to shift the position of notches V.

The notch forming sections 300A, 300B, 300C, and 300D in FIG. 12 are separated from one another. However, they can be integrated into one piece, and a plurality of punches can be installed on one notch forming section.

In the bookbinding system of FIG. 1, the image forming apparatus A and bookbinding apparatus B are separated from each other. However, they can be integrated into one apparatus.

What is claimed is:

1. A notch forming device configured to sequentially receive a plurality of sheets to form a sheet bundle from an image forming apparatus and to form a notch on each of the plurality of sheets, the notch forming device comprising:

a receiving section which receives information regarding the plurality of sheets and the sheet bundle from the image forming apparatus;

a notch forming section to form the notch on an edge of each sheet upon receipt of the sheet from the image forming apparatus;

a shifting section to shift a position of the notch to be formed on the sheet by the notch forming section; and a control section which controls the shifting section, the control section including:

a judging section which judges based on the information received from the image forming apparatus whether a sheet on which a notch is currently being formed is a last page of a current sheet bundle currently being output, and which further judges whether a next sheet bundle is to be output after the current sheet bundle, and a memory which is coupled to the notch forming section and which memorizes an initial position of a notch to be formed on a sheet of a leading page of a sheet bundle;

wherein when the judging section judges that the sheet on which the notch is currently being formed is the last page of the current sheet bundle, when the judging section further judges that the next sheet bundle is to be output after the current sheet bundle, the control section controls the shifting section so as to make a notch on a sheet of a leading page of the next sheet bundle at a same position as the initial position memorized in the memory such that a position of the notch formed on the sheet of the leading page of the next sheet bundle is the same as a position of the notch formed on a sheet of a leading page of the current sheet bundle regardless of a number of sheets in the current sheet bundle.

2. The notch forming device described in claim 1, wherein the control section controls the shifting section to shift a position where a notch is formed for every sheet or every predetermined number of sheets of a sheet bundle.

3. The notch forming device described in claim 1, further comprising a calculating section which calculates an adjusting time period for the shifting section to shift from a position of a notch to be formed on a last page of a previous sheet bundle to the position of the notch to be formed on the leading page of the next sheet bundle, and wherein a sheet conveying interval is adjusted based on a calculation result.

4. A bookbinding apparatus, comprising:

the notch forming device described in claim 1; and a bookbinding section which: (i) stacks sheets having notches formed on one side thereof by the notch forming device, (ii) forms a sheet bundle of the stacked sheets, and (iii) coats an adhesive on the one side of the sheet bundle by a coating device so as to bind the sheet bundle into a booklet.

5. A bookbinding system, comprising:

an image forming apparatus to form images on sheets; and the bookbinding apparatus described in claim 4 to produce a booklet with the sheets on which the images are formed by the image forming apparatus.

6. The notch forming device described in claim 1, wherein the memory memorizes a position of a notch formed for a sheet of a leading page of a first sheet bundle as the initial position.

7. The notch forming device described in claim 1, wherein when the judging section judges that the sheet on which the notch is currently being formed is the last page of the current sheet bundle, when the judging section further judges that the next sheet bundle is to be output after the current sheet bundle, the control section controls the shifting section so as to make the notch on the sheet of the leading page of the next sheet bundle at the same position as the initial position memorized in the memory such that a notch groove, which is formed on a spine of the next sheet bundle, has a same predetermined shape as a notch groove, which is formed on a spine of the current sheet bundle.

* * * * *

UNITED STATES PATENT AND TRADEMARK OFFICE

CERTIFICATE OF CORRECTION

PATENT NO. : 8,515,333 B2
APPLICATION NO. : 12/486984
DATED : August 20, 2013
INVENTOR(S) : Tomoya Motoyoshi It is certified that error appears in the above-identified patent and that said Letters Patent is hereby corrected as shown below:

On the Title Page; item (73) Assignee:

delete the second occurrence of the word "Business"

Signed and Sealed this
Eleventh Day of March, 2014

Michelle K. Lee

Michelle K. Lee
*Deputy Director of the United States Patent and Trademark Office*